US012391350B2

(12) United States Patent
Matsunaga et al.

(10) Patent No.: US 12,391,350 B2
(45) Date of Patent: Aug. 19, 2025

(54) OUTBOARD MOTOR AND MARINE VESSEL

(71) Applicant: YAMAHA HATSUDOKI KABUSHIKI KAISHA, Iwata (JP)

(72) Inventors: Takuma Matsunaga, Shizuoka (JP); Tomohiro Hagi, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 769 days.

(21) Appl. No.: 17/721,780

(22) Filed: Apr. 15, 2022

(65) Prior Publication Data

US 2022/0332401 A1 Oct. 20, 2022

(30) Foreign Application Priority Data

Apr. 20, 2021 (JP) ..... 2021-071161

(51) Int. Cl.
*B63H 20/12* (2006.01)
*B63H 20/00* (2006.01)
*B63H 25/02* (2006.01)

(52) U.S. Cl.
CPC ..... *B63H 20/12* (2013.01); *B63H 2020/003* (2013.01); *B63H 2025/022* (2013.01)

(58) Field of Classification Search
CPC ..... B63H 20/12; B63H 2020/003; B63H 2025/022
See application file for complete search history.

(56) References Cited

U.S. PATENT DOCUMENTS 3,475,911 A * 11/1969 Harrison ..... B63H 20/12 188/152
4,041,889 A * 8/1977 Blanchard ..... B63H 25/12 114/144 R
4,773,882 A * 9/1988 Rump ..... B63H 25/12 440/61 R
5,542,864 A * 8/1996 Peebles ..... F02B 61/045 91/450
5,601,463 A * 2/1997 Kobelt ..... B63H 20/12 440/61 C
7,150,664 B1 * 12/2006 Uppgard ..... B63H 20/12 440/61 C
7,160,163 B2 * 1/2007 Gai ..... B63H 20/12 440/61 S
9,651,151 B2 * 5/2017 Gai ..... B63H 20/12
2020/0307753 A1 * 10/2020 Mizutani ..... B63H 20/12

FOREIGN PATENT DOCUMENTS

EP 1488996 A2 * 12/2004 ..... B63H 25/12
JP 2003-232306 A 8/2003
JP 2006-207657 A 8/2006
JP 2020-168889 A 10/2020

OTHER PUBLICATIONS

Official Communication issued in corresponding European Patent Application No. 22168438.4, mailed on Oct. 11, 2022.

* cited by examiner

*Primary Examiner* — S. Joseph Morano
*Assistant Examiner* — Jovon E Hayes
(74) *Attorney, Agent, or Firm* — Keating & Bennett, LLP

(57) ABSTRACT

An outboard motor includes an oil chamber, an oil passage connected to the oil chamber via an oil passage connection port, and an air guide, located in a vicinity of or adjacent to the oil passage connection port in a right-left direction of an outboard motor body, to guide air remaining in the oil chamber to the oil passage connection port when hydraulic oil is discharged from the oil chamber via the oil passage.

20 Claims, 9 Drawing Sheets

OUTBOARD MOTOR AND MARINE VESSEL

CROSS REFERENCE TO RELATED APPLICATIONS

This application claims the benefit of priority to Japanese Patent Application No. 2021-071161 filed on Apr. 20, 2021. The entire contents of this application are hereby incorporated herein by reference.

BACKGROUND OF THE INVENTION

1. Field of the Invention

The present invention relates to an outboard motor and a marine vessel, and more particularly, it relates to an outboard motor and a marine vessel each including a steering cylinder that rotates a steering shaft to rotate an outboard motor body in a right-left direction.

2. Description of the Related Art

An outboard motor including a steering cylinder that rotates a steering shaft to rotate an outboard motor body in a right-left direction is known in general. Such an outboard motor is disclosed in Japanese Patent Laid-Open No. 2020-168889, for example.

Japanese Patent Laid-Open No. 2020-168889 discloses an outboard motor including a steering cylinder that exerts a steering force on an outboard motor body. In the outboard motor disclosed in Japanese Patent Laid-Open No. 2020-168889, the steering cylinder extends in a right-left direction. The steering cylinder is connected to a steering shaft via a link mechanism. An oil chamber in the steering cylinder is connected to a steering pump via an oil passage, and hydraulic oil is supplied to and discharged from the oil chamber. The steering cylinder is driven (is moved in the right-left direction) by the hydraulic oil to generate a steering force so as to rotate the outboard motor body about the steering shaft. In the outboard motor disclosed in Japanese Patent Laid-Open No. 2020-168889, a connection port of the oil chamber in the steering cylinder to the oil passage is provided on the side of (lateral to) the steering cylinder that extends in the right-left direction.

In the outboard motor disclosed in Japanese Patent Laid-Open No. 2020-168889, as described above, the connection port of the oil chamber in the steering cylinder to the oil passage is provided on the side of (lateral to) the steering cylinder, and thus when air enters the oil chamber, the air stays in the oil chamber without escaping. When the air stays in the oil chamber, the operation of the steering cylinder may become unstable. Therefore, although not clearly described in Japanese Patent Laid-Open No. 2020-168889, an operator performs an operation to discharge air from the oil chamber to the outside (an air bleeding operation for the oil chamber) when air enters the oil chamber in a conventional outboard motor as disclosed in Japanese Patent Laid-Open No. 2020-168889. The air bleeding operation for the oil chamber includes a complex operation such as tilting a steering cylinder such that a connection port to an oil passage is located on the upper side of the steering cylinder after removing the steering cylinder from an outboard motor body, for example. Therefore, it is desired to easily bleed air from the oil chamber in the steering cylinder.

SUMMARY OF THE INVENTION

Preferred embodiments of the present invention provide outboard motors and marine vessels that each facilitate air bleeding from oil chambers in steering cylinders.

An outboard motor according to a preferred embodiment of the present invention includes an outboard motor body, a steering shaft, a steering cylinder including a piston rod extending in a right-left direction of the outboard motor body, a piston fixed to the piston rod, and a cylinder body including therein the piston and an oil chamber to store hydraulic oil, an oil passage connected to the oil chamber via an oil passage connection port to supply the hydraulic oil to the oil chamber and discharge the hydraulic oil from the oil chamber, and an air guide, located in a vicinity of or adjacent to the oil passage connection port in the right-left direction, to guide air remaining in the oil chamber to the oil passage connection port when the hydraulic oil is discharged from the oil chamber via the oil passage, wherein the steering cylinder is operable to rotate the steering shaft and the outboard motor body in the right-left direction by adjusting an amount of the hydraulic oil in the oil chamber and moving the cylinder body in the right-left direction.

An outboard motor according to a preferred embodiment of the present invention includes the air guide located in the right-left direction in the vicinity of or adjacent to the oil passage connection port to guide the air remaining in the oil chamber to the oil passage connection port when the hydraulic oil is discharged from the oil chamber via the oil passage. Accordingly, when the hydraulic oil is discharged from the oil chamber via the oil passage, the air guide guides the air remaining in the oil chamber to the oil passage connection port. That is, the air remaining in the oil chamber is guided to the oil passage connection port by the normal operation of the steering cylinder that discharges the hydraulic oil from the oil chamber via the oil passage, and thus the air is automatically discharged from the oil chamber to the outside without an operator performing a complex operation such as tilting the steering cylinder. Consequently, the air in the oil chamber of the steering cylinder is easily bled therefrom. Furthermore, the air is bled at any time only by a user of a marine vessel performing a steering operation (to change the propulsion direction of the marine vessel) while maneuvering the marine vessel, without the operator performing an air bleeding operation.

In an outboard motor according to a preferred embodiment of the present invention, the air guide preferably guides air remaining in an upper portion of the oil chamber to the oil passage connection port via an outer peripheral side flow passage provided on an outer peripheral side of the air guide when the hydraulic oil is discharged from the oil chamber. Accordingly, the upper portion (outer peripheral side) of the oil chamber is closer to the outer peripheral side flow passage than the inner peripheral side of the oil chamber, and the air is lower in viscosity than the hydraulic oil, and thus when the hydraulic oil is discharged from the oil chamber via the oil passage, the air remaining in the upper portion (outer peripheral side) of the oil chamber is preferentially discharged to the outside from the oil chamber via the outer peripheral side flow passage. Consequently, when the hydraulic oil is discharged from the oil chamber via the oil passage, the air guide reliably guides the air remaining in the upper portion of the oil chamber to the oil passage connection port.

In such a case, the air guide preferably has a disk shape, and the outer peripheral side flow passage is preferably defined by an outer peripheral surface of the air guide and an inner peripheral surface of the oil chamber. Accordingly, with the air guide, the outer peripheral side flow passage that guides the air remaining in the upper portion (outer peripheral side) of the oil chamber to the oil passage connection port is easily provided on the outer peripheral side of the air guide.

In an outboard motor in which the air remaining in the upper portion of the oil chamber is guided to the oil passage connection port via the outer peripheral side flow passage provided on the outer peripheral side of the air guide, the air guide preferably supplies the hydraulic oil to the oil chamber via an inner peripheral side flow passage provided on an inner peripheral side of the outer peripheral side flow passage in addition to the outer peripheral side flow passage when the hydraulic oil is supplied to the oil chamber. Accordingly, when the hydraulic oil is supplied to the oil chamber, the sectional area of a flow passage through which the hydraulic oil is supplied is increased as compared with a case in which the flow passage through which the hydraulic oil is supplied is limited to the outer peripheral side flow passage. Consequently, the pressure loss of the hydraulic oil is decreased when the hydraulic oil is supplied to the oil chamber.

In such a case, the air guide preferably moves in the right-left direction in the oil chamber to close the inner peripheral side flow passage when the hydraulic oil is discharged from the oil chamber and to open the inner peripheral side flow passage when the hydraulic oil is supplied to the oil chamber. Accordingly, the air guide is moved in the right-left direction in the oil chamber such that the outer peripheral side flow passage is easily provided when the hydraulic oil is discharged from the oil chamber, and the outer peripheral side flow passage and the inner peripheral side flow passage are easily provided when the hydraulic oil is supplied to the oil chamber.

In an outboard motor including the air guide that moves in the right-left direction in the oil chamber, the air guide preferably includes a contact portion to contact an end surface of the oil chamber in the right-left direction, and the air guide preferably moves in the right-left direction to a contact position at which the contact portion contacts the end surface to close the inner peripheral side flow passage when the hydraulic oil is discharged from the oil chamber, and moves in the right-left direction to a separated position at which the contact portion is spaced apart from the end surface to open the inner peripheral side flow passage when the hydraulic oil is supplied to the oil chamber. Accordingly, the air guide is moved in the right-left direction between the contact position and the separated position in the oil chamber such that the inner peripheral side flow passage is easily closed when the hydraulic oil is discharged from the oil chamber, and the inner peripheral side flow passage is easily opened when the hydraulic oil is supplied to the oil chamber.

In such a case, the air guide preferably moves to the contact position in the right-left direction due to a flow of the hydraulic oil discharged from the oil chamber to the oil passage connection port when the hydraulic oil is discharged from the oil chamber, and moves to the separated position in the right-left direction due to a flow of the hydraulic oil supplied from the oil passage connection port to the oil chamber when the hydraulic oil is supplied to the oil chamber. Accordingly, the air guide is moved to the contact position in the right-left direction through the normal operation of the steering cylinder that discharges the hydraulic oil from the oil chamber, and the air guide is moved to the separated position in the right-left direction through the normal operation of the steering cylinder that supplies the hydraulic oil to the oil passage, and thus the air guide is moved in the right-left direction to the contact position and the separated position in the oil chamber without separately providing a dedicated movement mechanism to move the air guide.

An outboard motor including the air guide that moves in the right-left direction to the contact position when the hydraulic oil is discharged from the oil chamber, and moves in the right-left direction to the separated position when the hydraulic oil is supplied to the oil chamber preferably further includes a restrictor to restrict the air guide from moving to a side opposite to the contact position relative to the separated position in the right-left direction. Accordingly, the moving range of the air guide is limited between the contact position and the separated position in the right-left direction by the restrictor, and thus an excessive increase in the moving range of the air guide is significantly reduced or prevented.

In an outboard motor including the air guide that moves in the right-left direction to the contact position when the hydraulic oil is discharged from the oil chamber, and moves in the right-left direction to the separated position when the hydraulic oil is supplied to the oil chamber, the oil passage connection port is preferably located in a vicinity of or adjacent to the end surface in the right-left direction. Accordingly, the separated position is located relatively close to the end surface in the right-left direction, and thus an excessive increase in the moving range of the air guide is significantly reduced or prevented.

In an outboard motor including the air guide that moves in the right-left direction to the contact position when the hydraulic oil is discharged from the oil chamber, and moves in the right-left direction to the separated position when the hydraulic oil is supplied to the oil chamber, the oil passage is preferably provided in the piston rod, the oil passage connection port is preferably provided on an outer peripheral surface of the piston rod, the piston rod is preferably provided on an inner peripheral side of the oil chamber, and the air guide preferably further includes, as the contact portion, a plurality of first protrusions that protrude toward the end surface in the right-left direction, and an inside-outside connection recess located between the plurality of first protrusions to connect an outer peripheral side of the oil chamber to the inner peripheral side. Accordingly, the plurality of first protrusions corresponding to the contact portion easily close the inner peripheral side flow passage when the hydraulic oil is discharged from the oil chamber, and easily open the inner peripheral side flow passage when the hydraulic oil is supplied to the oil chamber. Furthermore, the inside-outside connection recess easily connects, on the end surface side of the air guide, the outer peripheral side flow passage to the oil passage connection port provided on the outer peripheral surface of the piston rod on the inner peripheral side when the hydraulic oil is discharged from the oil chamber, and easily connects, on the end surface side of the air guide, the outer peripheral side flow passage and the inner peripheral side flow passage to the oil passage connection port when the hydraulic oil is supplied to the oil chamber.

In such a case, the air guide preferably further includes, as the inner peripheral side flow passage, a through-hole provided on at least one of the plurality of first protrusions extending therethrough in the right-left direction. Accordingly, with the through-hole, the inner peripheral side flow passage, which is closed due to contact of the plurality of first protrusions with the end surface in the right-left direction when the hydraulic oil is discharged from the oil chamber, and is opened due to being spaced apart from the plurality of first protrusions from the end surface in the right-left direction when the hydraulic oil is supplied to the oil chamber, is easily provided.

In an outboard motor including the air guide that includes the through-hole as the inner peripheral side flow passage, the through-hole is preferably provided on each of the plurality of first protrusions. Accordingly, the sectional area of the inner peripheral side flow passage is easily increased as compared with a case in which the through-hole is provided on one or more but not all of the plurality of first protrusions. Consequently, the pressure loss of the hydraulic oil is effectively decreased when the hydraulic oil is supplied to the oil chamber.

In an outboard motor including the air guide that includes the through-hole as the inner peripheral side flow passage, the plurality of first protrusions each preferably have a sectoral shape as viewed in the right-left direction, and the through-hole preferably has a sectoral shape smaller than the sectoral shape of each of the plurality of first protrusions as viewed in the right-left direction. Accordingly, the sectional area of the inner peripheral side flow passage is easily increased as compared with a case in which the through-hole does not have the same sectoral shape as the plurality of first protrusions. Consequently, the pressure loss of the hydraulic oil is effectively decreased when the hydraulic oil is supplied to the oil chamber.

In an outboard motor in which the oil passage connection port is provided on the outer peripheral surface of the piston provided in the cylinder body, the oil passage connection port is preferably provided on a portion of the outer peripheral surface in a circumferential direction of the piston rod, and the air guide preferably further includes a first annular recess recessed away from the end surface with respect to the plurality of first protrusions on the inner peripheral side to connect the inside-outside connection recess to the oil passage connection port. Accordingly, the inside-outside connection recess that connects the outer peripheral side to the inner peripheral side is easily connected to the oil passage connection port provided on a portion of the outer peripheral surface of the piston rod in the circumferential direction by the first annular recess.

In an outboard motor including the air guide that moves in the right-left direction to the contact position when the hydraulic oil is discharged from the oil chamber, and moves in the right-left direction to the separated position when the hydraulic oil is supplied to the oil chamber, the oil passage is preferably located in front of, behind, or below the steering cylinder, the oil passage connection port is preferably provided on an inner peripheral surface of the cylinder body, and the air guide preferably further includes, as the contact portion, a second protrusion that protrudes toward the end surface in the oil chamber. Accordingly, the second protrusion corresponding to the contact portion easily closes the inner peripheral side flow passage when the hydraulic oil is discharged from the oil chamber, and easily opens the inner peripheral side flow passage when the hydraulic oil is supplied to the oil chamber.

In such a case, the air guide preferably further includes, as the outer peripheral side flow passage, a notch provided on the outer peripheral side of the air guide extending therethrough in the right-left direction. Accordingly, with the notch, the outer peripheral side flow passage is easily provided in the oil chamber when the hydraulic oil is discharged from the oil chamber.

In an outboard motor in which the oil passage connection port is provided on the inner peripheral surface of the cylinder body, the oil passage connection port is preferably provided on a portion of the inner peripheral surface in a circumferential direction of the cylinder body, and the air guide preferably further includes a second annular recess recessed away from the end surface with respect to the second protrusion on the outer peripheral side of the air guide and connected to the oil passage connection port. Accordingly, the outer peripheral side flow passage is easily connected to the oil passage connection port provided on a portion of the inner peripheral surface of the cylinder body in the circumferential direction by the second annular recess.

A marine vessel according to a preferred embodiment of the present invention includes a hull including a steering wheel, and an outboard motor attached to the hull. The outboard motor includes an outboard motor body, a steering shaft, a steering cylinder including a piston rod extending in a right-left direction of the outboard motor body, a piston fixed to the piston rod, and a cylinder body including therein the piston and an oil chamber to store hydraulic oil, an oil passage connected to the oil chamber via an oil passage connection portion to supply the hydraulic oil to the oil chamber and discharge the hydraulic oil from the oil chamber, and an air guide, located in a vicinity of or adjacent to the oil passage connection port in the right-left direction, to guide air remaining in the oil chamber to the oil passage connection port when the hydraulic oil is discharged from the oil chamber via the oil passage, wherein the steering cylinder is operable to rotate the steering shaft and the outboard motor body in the right-left direction by adjusting an amount of the hydraulic oil in the oil chamber and moving the cylinder body in the right-left direction based on an operation of the steering wheel.

A marine vessel according to a preferred embodiment of the present invention includes the air guide, located in the right-left direction in the vicinity of or adjacent to the oil passage connection port connecting the oil chamber to the oil passage, to guide the air remaining in the oil chamber to the oil passage connection port when the hydraulic oil is discharged from the oil chamber via the oil passage. Accordingly, similarly to the outboard motors according to preferred embodiments of the present invention described above, the air remaining in the oil chamber is guided to the oil passage connection port by the normal operation of the steering cylinder that discharges the hydraulic oil from the oil chamber via the oil passage, and thus the air is automatically discharged from the oil chamber to the outside without an operator performing a complex operation such as tilting the steering cylinder. Consequently, similarly to the outboard motors according to preferred embodiments of the present invention described above, the air in the oil chamber of the steering cylinder is easily bled.

In a marine vessel according to a preferred embodiment of the present invention, the air guide preferably guides air remaining in an upper portion of the oil chamber to the oil passage connection port via an outer peripheral side flow passage provided on an outer peripheral side of the air guide when the hydraulic oil is discharged from the oil chamber. Accordingly, similarly to the outboard motors according to preferred embodiments of the present invention described above, when the hydraulic oil is discharged from the oil chamber via the oil passage, the air remaining in the upper portion (outer peripheral side) of the oil chamber is preferentially discharged to the outside from the oil chamber via the outer peripheral side flow passage. Consequently, similarly to the outboard motors according to preferred embodiments of the present invention described above, when the hydraulic oil is discharged from the oil chamber via the oil passage, the air guide reliably guides the air remaining in the upper portion of the oil chamber to the oil passage connection port.

In such a case, the air guide preferably has a disk shape, and the outer peripheral side flow passage is preferably defined by an outer peripheral surface of the air guide and an inner peripheral surface of the oil chamber. Accordingly, similarly to the outboard motors according to preferred embodiments of the present invention described above, with the disk-shaped air guide, the outer peripheral side flow passage that guides the air remaining in the upper portion (outer peripheral side) of the oil chamber to the oil passage connection port is easily provided on the outer peripheral side of the air guide.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention are hereinafter described with reference to the drawings.

First Preferred Embodiment

The structure of a marine vessel 100 including outboard motors 120 (two outboard motors, for example) according to a first preferred embodiment of the present invention is now described with reference to FIGS. 1 to 8.

Figure 1:
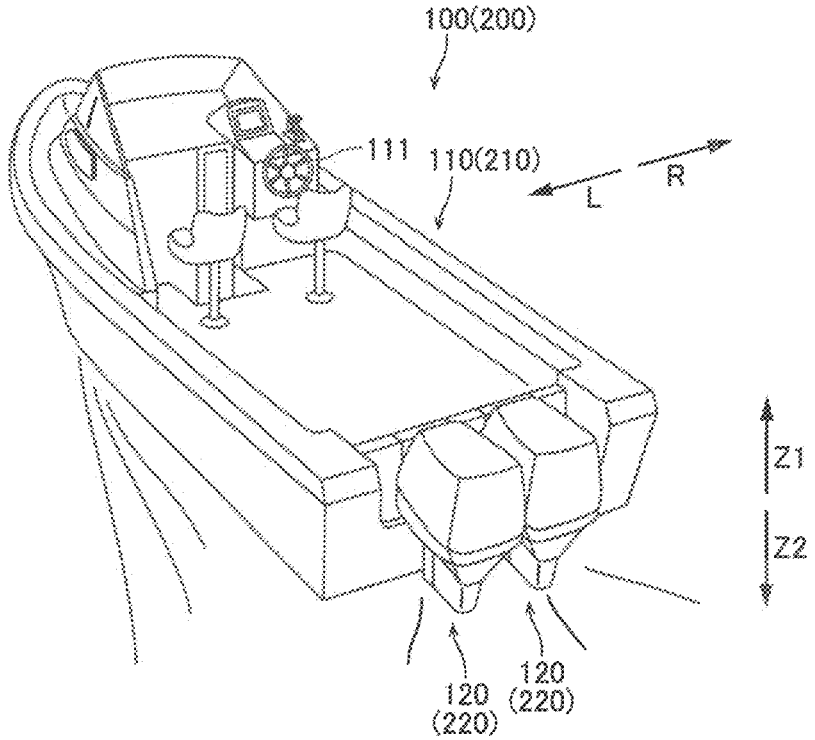
FIG. 1 is a perspective view showing a marine vessel including outboard motors according to first and second preferred embodiments of the present invention.

As shown in FIG. 1, the marine vessel 100 includes a hull 110 and the outboard motors 120. The outboard motors 120 are attached to a rear transom of the hull 110. The outboard motors 120 are marine propulsion devices that propel the hull 110. The marine vessel 100 may be used for sightseeing in a canal and a lake, for example. The marine vessel 100 may be a relatively small marine vessel.

In the figures, arrow FWD and arrow BWD represent the front side and the rear side of the marine vessel 100, respectively. In the figures, arrow L and arrow R represent the left side and the right side of the marine vessel 100, respectively. In the figures, arrow Z1 and arrow Z2 represent the upper side and the lower side of the marine vessel 100, respectively.

The hull 110 includes a steering wheel 111. The steering wheel 111 receives a user's operation to cause the outboard motors 120 to change the propulsion direction of the hull 110. As a user operates the steering wheel 111, an electric signal is transmitted from the steering wheel 111 to a steering control unit (not shown) provided in each of the outboard motors 120. The steering control unit controls a steering motor **46*b* (see FIG. 4) of a steering device 40 (see FIG. 2) provided in each of the outboard motors 120 to change the propulsion direction of the hull 110 based on the electric signal transmitted from the steering wheel 111**.

Figure 2:
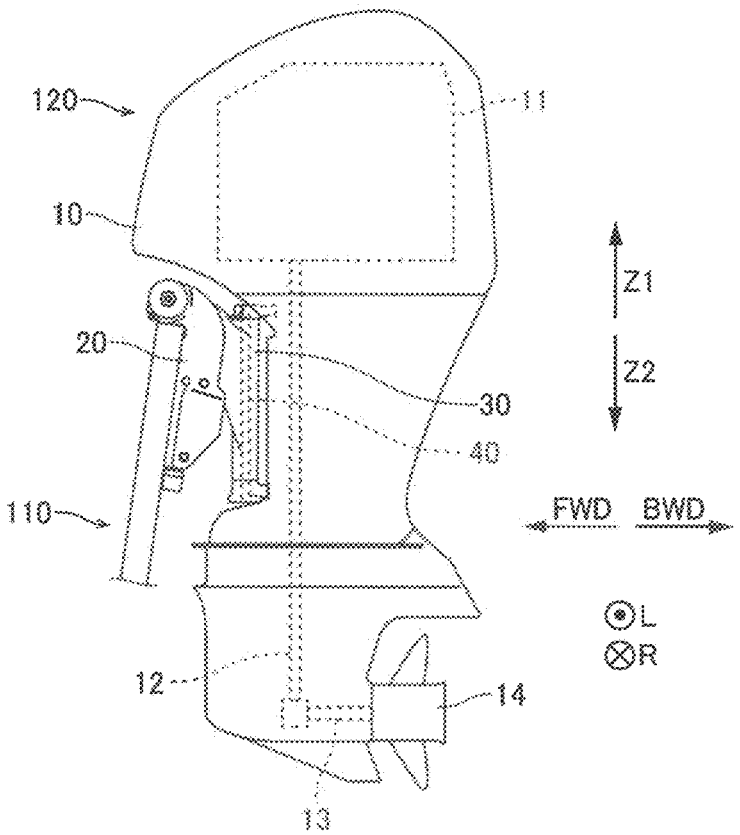
FIG. 2 is a left side view showing the overall structure of one of the outboard motors according to the first preferred embodiment of the present invention.

As shown in FIG. 2, the outboard motors 120 each include an outboard motor body 10, a pair of clamp brackets 20 to attach the outboard motor body 10 to the transom of the hull 110, and a swivel bracket 30 to support the outboard motor body 10. Furthermore, the outboard motors 120 each include a hydraulic power trim-tilt device (not shown) to rotate the outboard motor body 10 in an upward-downward direction and the hydraulic steering device 40 to rotate the outboard motor body 10 in a right-left direction.

The outboard motor body 10 includes an engine 11, a drive shaft 12, a propeller shaft 13, and a propeller 14. The engine 11 is, for example, an internal combustion engine that generates a driving force. The drive shaft 12 and the propeller shaft 13 transmit a driving force from the engine 11 to the propeller 14. The propeller 14 generates a thrust force (a propulsive force to propel the hull 110) by rotating in the water with the driving force transmitted from the engine 11.

The outboard motor body 10 is rotated in the upward-downward direction together with the swivel bracket 30 with respect to the clamp brackets 20 by the power trim-tilt device. Thus, when the hull 110 is propelled, the upward-downward orientation of the propeller 14 positioned in the water is adjusted, and when the hull 110 is stopped or starts to be propelled, the position of the propeller 14 is changed between underwater and above water. Furthermore, the outboard motor body 10 is rotated in the right-left direction with respect to the swivel bracket 30 (clamp brackets 20) by the steering device 40. Thus, when the hull 110 is propelled, the right-left orientation of the propeller 14 positioned in the water is adjusted.

Figure 3:
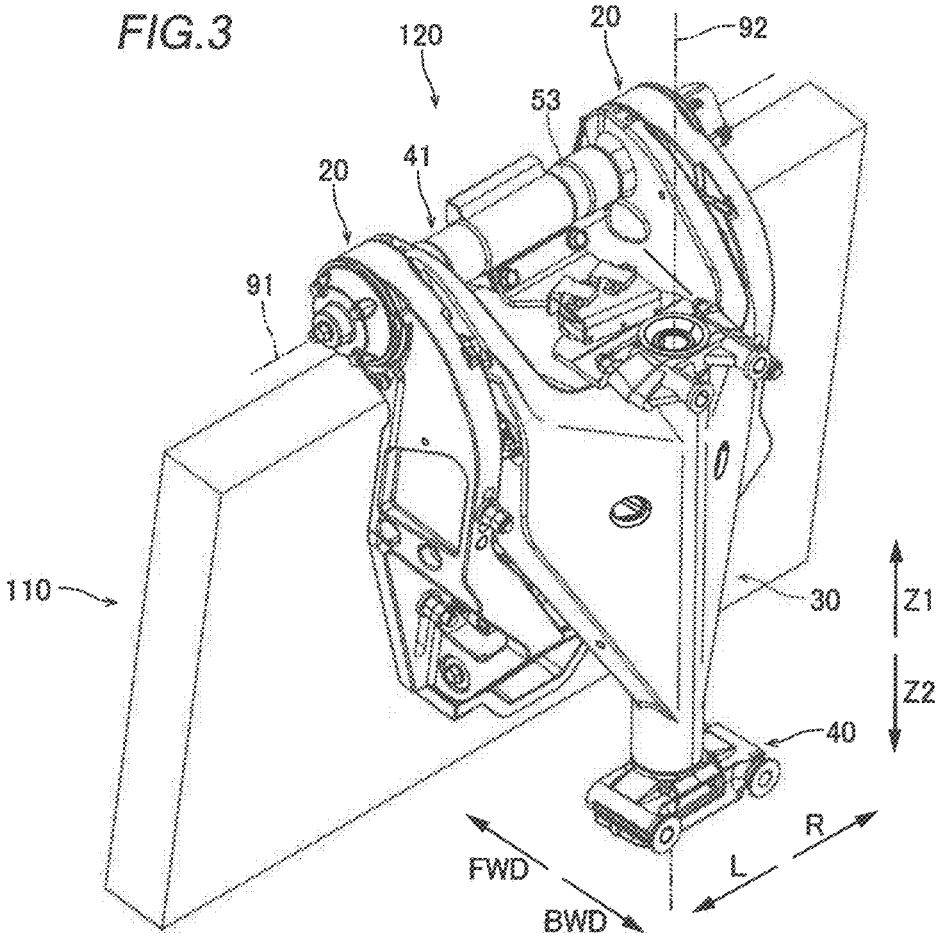
FIG. 3 is a perspective view showing clamp brackets, a swivel bracket, a steering cylinder, a steering device, etc. of the outboard motor according to the first preferred embodiment of the present invention.

As shown in FIG. 3, the clamp brackets 20 are attached to the transom of the hull 110. A pair of clamp brackets 20 are spaced apart from each other in the right-left direction. The swivel bracket 30 is attached to the clamp brackets 20 so as to be rotatable about a tilt shaft (not shown) that extends in the right-left direction. The outboard motor body 10 is attached to the swivel bracket 30 via a steering shaft (not shown) that extends in the upward-downward direction. That is, the clamp brackets 20 rotatably support the swivel bracket 30 and the outboard motor body 10.

The swivel bracket 30 is located between the pair of clamp brackets 20 in the right-left direction. The swivel bracket 30 is attached to the pair of clamp brackets 20 via the tilt shaft. The swivel bracket 30 rotates in the upward-downward direction by rotating about the tilt shaft.

The power trim-tilt device is attached to the clamp brackets 20. The power trim-tilt device is located between the pair of clamp brackets 20. The power trim-tilt device rotates the swivel bracket 30 and the outboard motor body 10 in the upward-downward direction about the central axis 91 of the tilt shaft.

Figure 4:
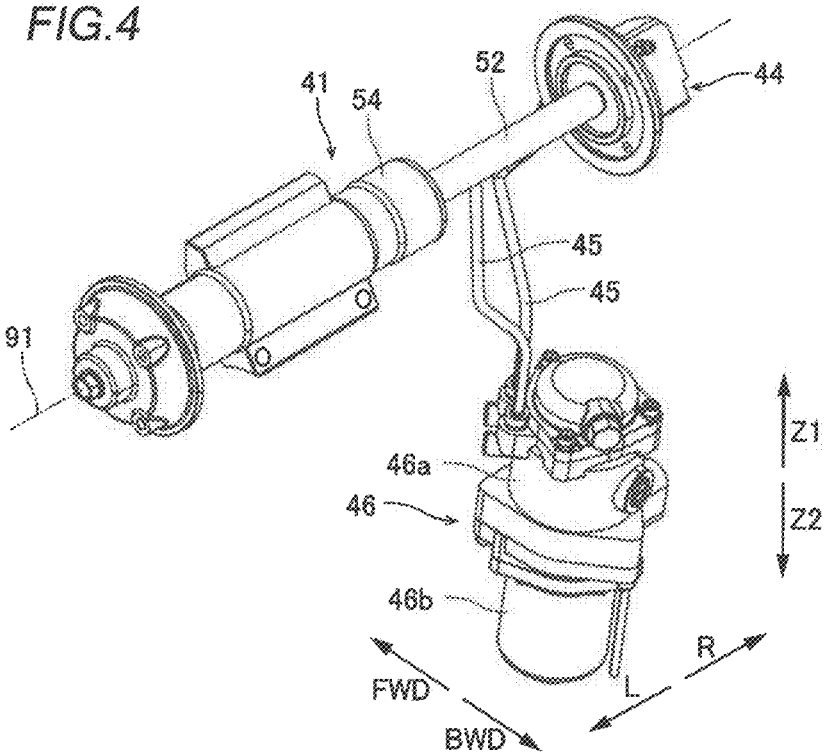
FIG. 4 is a perspective view showing the steering cylinder, oil pipes, a steering pump, etc. of the outboard motor according to the first preferred embodiment of the present invention.
Figure 5:
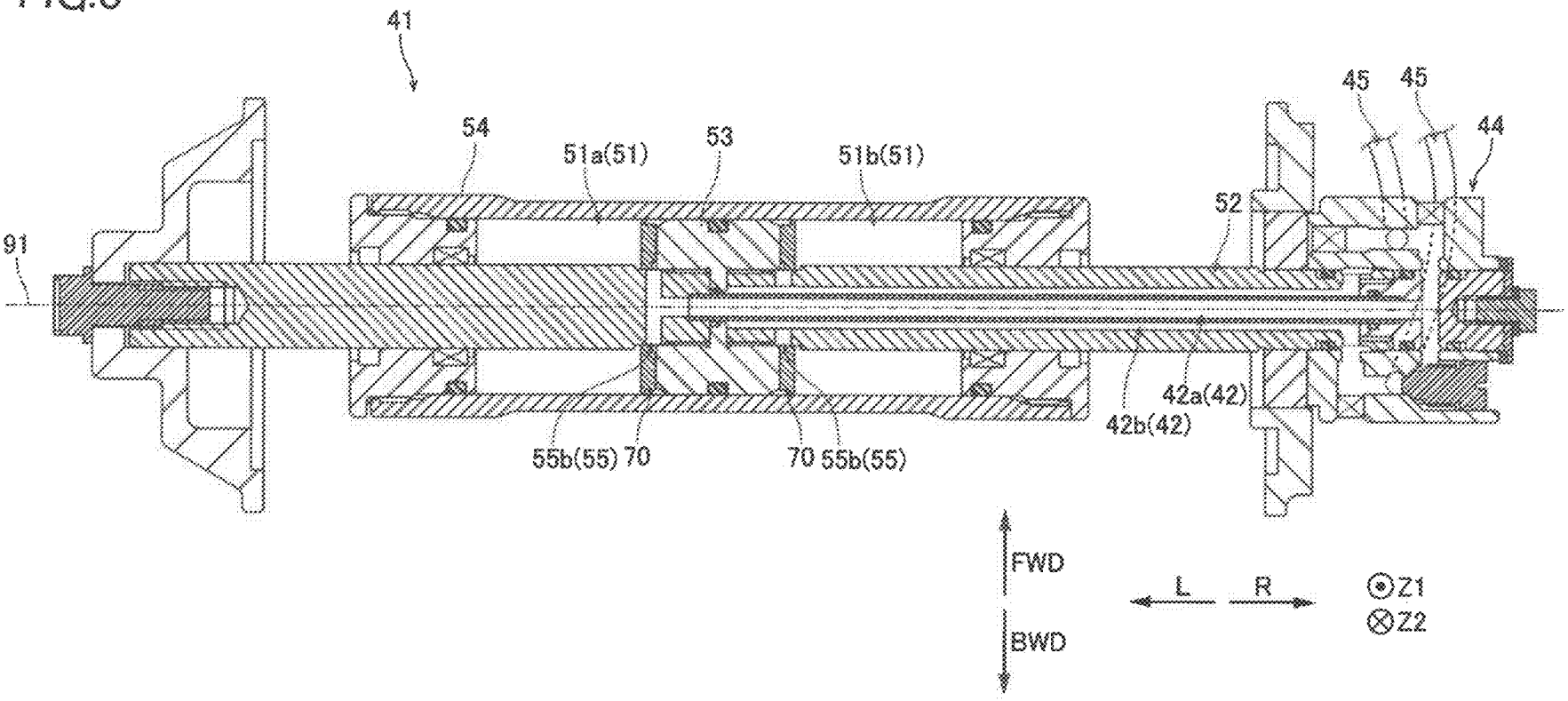
FIG. 5 is a plan sectional view showing the overall structure of the steering cylinder of the outboard motor according to the first preferred embodiment of the present invention.

As shown in FIG. 4, the steering device 40 includes a steering cylinder 41, an oil passage 42 (see FIG. 5), an adapter 44, oil pipes 45, and a steering oil supply/discharge device 46. As shown in FIG. 5, the steering cylinder 41 includes an oil chamber 51 to store hydraulic oil. As shown in FIG. 4, the steering oil supply/discharge device 46 includes a steering pump 46*a* and a steering motor 46*b*. The oil chamber 51 (see FIG. 5) is connected to the steering pump 46*a* via the oil passage 42, the adapter 44, and the oil pipes 45. The steering motor 46*b* drives the steering pump 46*a* under the control of the steering control unit to supply the hydraulic oil from the steering pump 46*a* to the oil chamber 51 and discharge the hydraulic oil from the oil chamber 51 to the outside. That is, the oil passage 42 is provided to supply the hydraulic oil to the oil chamber 51 and discharge the hydraulic oil from the oil chamber 51.

As shown in FIG. 5, the steering cylinder 41 includes a piston rod 52 that extends in the right-left direction of the outboard motor body 10, a piston 53 fixed to the piston rod 52, and a cylinder body 54 with the piston 53 therein and the oil chamber 51 therein to store hydraulic oil. Specifically, a left end and a right end of the piston rod 52 that extends in the right-left direction are supported by the pair of clamp brackets 20, respectively, while being rotatable with respect to the pair of clamp brackets 20. The piston 53 is fixed to the piston rod 52 in a central portion between the pair of clamp brackets 20 in the right-left direction. The piston 53 divides the internal space of the cylinder body 54 into a space on the left side of the piston 53 and a space on the right side of the piston 53. Thus, a left oil chamber 51*a* on the left side of the piston 53 and a right oil chamber 51*b* on the right side of the piston 53 are provided in the cylinder body 54 as the oil chamber 51 that stores hydraulic oil.

The steering cylinder 41 adjusts the amount of hydraulic oil in the oil chamber 51 to move the cylinder body 54 in the right-left direction so as to rotate the steering shaft and the outboard motor body 10 (see FIG. 3) in the right-left direction. Specifically, the steering cylinder 41 is rotatably attached to the clamp brackets 20 (see FIG. 3) via the piston rod 52. The steering oil supply/discharge device 46 (see FIG. 4) supplies hydraulic oil to one of the left oil chamber 51*a* and the right oil chamber 51*b*, and discharges hydraulic oil from the other of the left oil chamber 51*a* and the right oil chamber 51*b*. Thus, with an increase in the hydraulic oil stored in one of the left oil chamber 51*a* and the right oil chamber 51*b* and a decrease in the hydraulic oil stored in the other of the left oil chamber 51*a* and the right oil chamber 51*b*, the cylinder body 54 moves in the right-left direction. The movement of the cylinder body 54 in the right-left direction is transmitted to the steering shaft, and the steering shaft rotates in the right-left direction. Thus, the outboard motor body 10 attached to the steering shaft rotates about the central axis 92 of the steering shaft in the right-left direction, and the propulsion direction of the hull 110 is changed.

In the first preferred embodiment, the oil passage 42 is provided in the piston rod 52. Specifically, the oil passage 42 including a first end connected to the oil pipes 45 (see FIG. 4) and a second end connected to the oil chamber 51 is provided inside the piston rod 52. The oil passage 42 includes an oil passage 42*a* connected to the left oil chamber 51*a* and an oil passage 42*b* connected to the right oil chamber 51*b*. The piston rod 52 has a double pipe structure. The oil passage 42*a* is an inner pipe of the double pipe. The oil passage 42*b* is a region between the inner pipe and an outer pipe of the double pipe.

In the first preferred embodiment, an oil passage connection port 55, which is a connection port of the oil chamber 51 to the oil passage 42, is provided on a portion of the outer peripheral surface 52*a* of the piston rod 52 provided in the cylinder body 54 in the circumferential direction. Specifically, an oil passage connection port 55*a* of the oil passage 42*a* connected to the left oil chamber 51*a* extends from the inner pipe of the double pipe to an end (outer peripheral surface 52*a*) of the left oil chamber 51*a* on the piston rod 52 side toward the outer peripheral side of the piston rod 52 inside the piston rod 52. An oil passage connection port 55*b* of the oil passage 42*b* connected to the right oil chamber 51*b* extends from the outer pipe of the double pipe to an end (outer peripheral surface 52*a*) of the right oil chamber 51*b* on the piston rod 52 side toward the outer peripheral side of the piston rod 52 inside the piston rod 52. A plurality of (four, for example) oil passage connection ports 55*a* and a plurality of (four, for example) oil passage connection ports 55*b* are provided at equal or substantially equal intervals in the circumferential direction as viewed in the axial direction (right-left direction) of the piston rod 52.

In the first preferred embodiment, the oil passage connection port 55 is located in the vicinity of or adjacent to an end surface 56 of the oil chamber 51 in the right-left direction. Specifically, the oil passage connection port 55*a* of the oil passage 42*a* connected to the left oil chamber 51*a* is located such that the position of the oil passage connection port 55*a* on the piston 53 side (right side) in the right-left direction and the location of the end surface 56*a* of the left oil chamber 51*a* on the piston 53 side are the same or substantially the same as each other in the right-left direction. Similarly, the oil passage connection port 55*b* of the oil passage 42*b* connected to the right oil chamber 51*b* is positioned such that the location of the oil passage connection port 55*b* on the piston 53 side (left side) in the right-left direction and the location of the end surface 56*b* of the right oil chamber 51*b* on the piston 53 side are the same or substantially the same as each other in the right-left direction.

Figure 6:
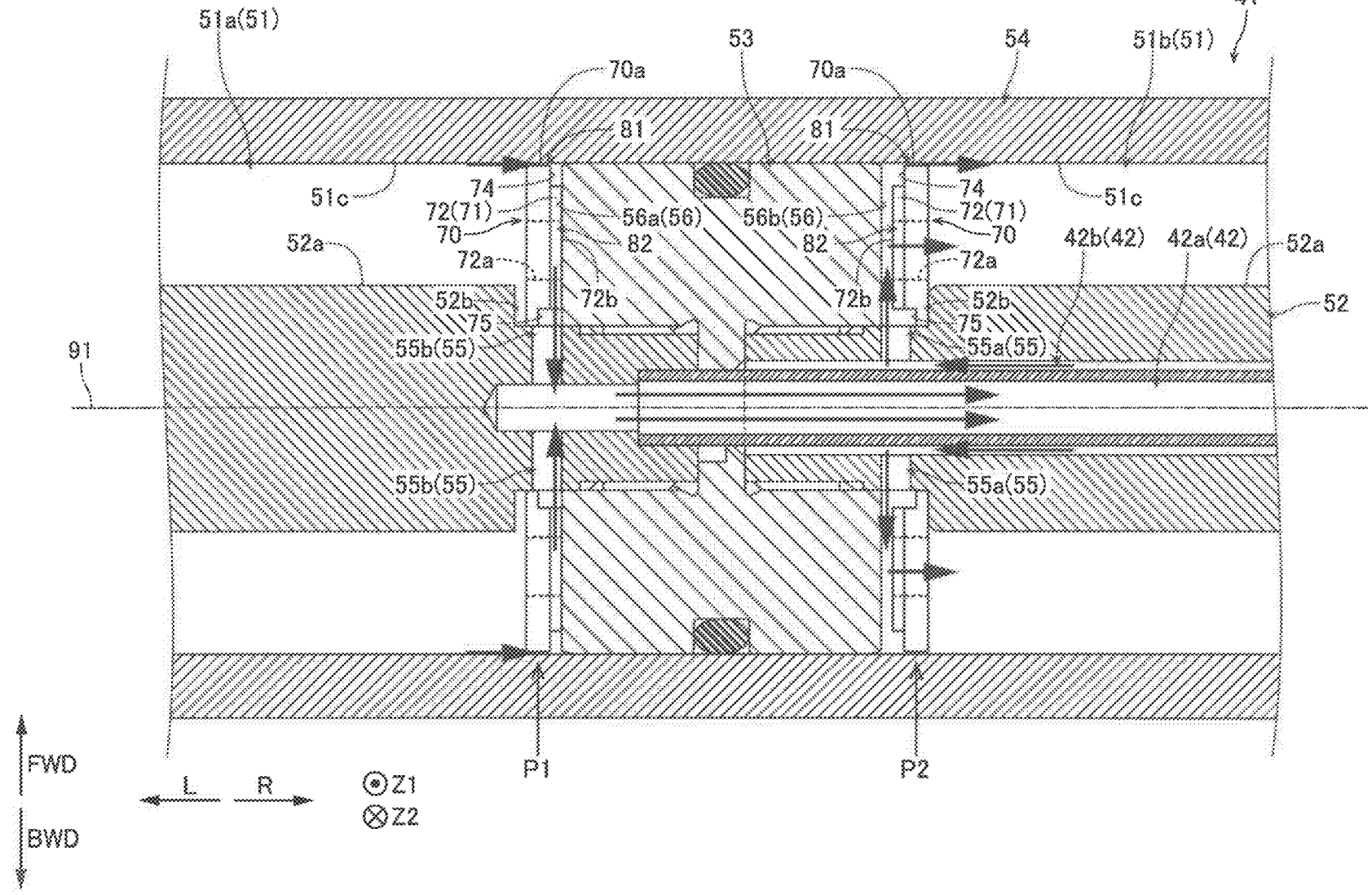
FIG. 6 is an enlarged plan sectional view of the vicinity of a piston of the steering cylinder of the outboard motor according to the first preferred embodiment of the present invention.

As shown in FIG. 6, in the first preferred embodiment, the outboard motor 120 (see FIG. 2) includes an air guide 70 located in the vicinity of or adjacent to the oil passage connection port 55 to guide air 60 remaining in the oil chamber 51 to the oil passage connection port 55 when the hydraulic oil is discharged from the oil chamber 51 via the oil passage 42. The air 60 (see FIG. 7) remaining in the oil chamber 51 includes air that remains in the oil chamber 51 without being discharged from the oil passage connection port 55 after the air 60 enters the oil chamber 51 when the steering cylinder 41 is assembled, for example. FIG. 6 shows a state in which the hydraulic oil is discharged from the left oil chamber 51*a* to the oil passage 42*a* via the oil passage connection port 55*a*, and the hydraulic oil is supplied from the oil passage 42*b* to the right oil chamber 51*b* via the oil passage connection port 55*b*. In FIG. 6, the hatching of the air guide 70 indicating a cross-section is omitted in order to clearly show the shape of the air guide 70.

Figure 7:
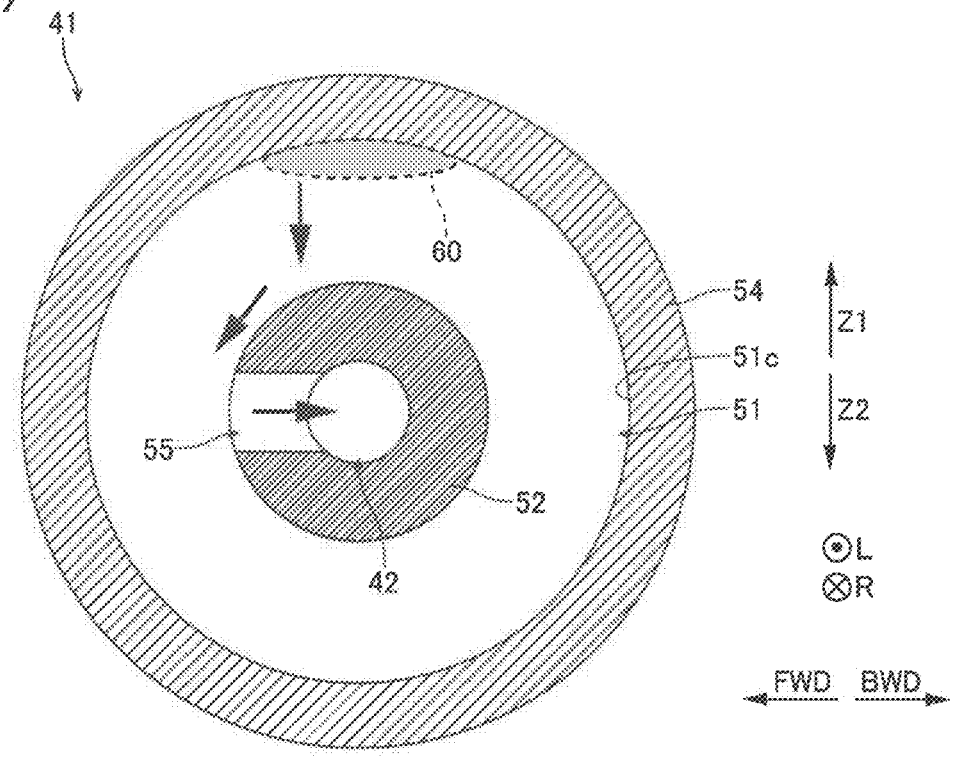
FIG. 7 is a schematic sectional view illustrating air discharge from an oil chamber of the steering cylinder of the outboard motor according to the first preferred embodiment of the present invention.

In the first preferred embodiment, when the hydraulic oil is discharged from the oil chamber 51, the air guide 70 guides the air 60 remaining in an upper portion of the oil chamber 51 to the oil passage connection port 55 via an outer peripheral side flow passage 81 provided on the outer peripheral side of the air guide 70. Specifically, as shown in FIG. 7, the air 60 is lighter than the hydraulic oil, and thus the air 60 that has entered the oil chamber 51 remains in the upper portion of the oil chamber 51. The oil chamber 51 has a circular shape as viewed in the axial direction of the piston rod 52, and thus the upper portion of the oil chamber 51 includes a portion of the oil chamber 51 on the outer peripheral side. Furthermore, the air 60 is lower in viscosity than the hydraulic oil. Therefore, as shown in FIG. 6, when the hydraulic oil is discharged from the oil chamber 51 to the oil passage 42 via the outer peripheral side flow passage 81, the air 60 remaining in the upper portion (outer peripheral side) of the oil chamber 51 is preferentially discharged. In FIG. 7, the piston rod 52 having a double pipe structure is simplified and drawn as a single pipe structure, and a plurality of oil passage connection ports 55 are simplified and drawn as only one.

Figure 8:
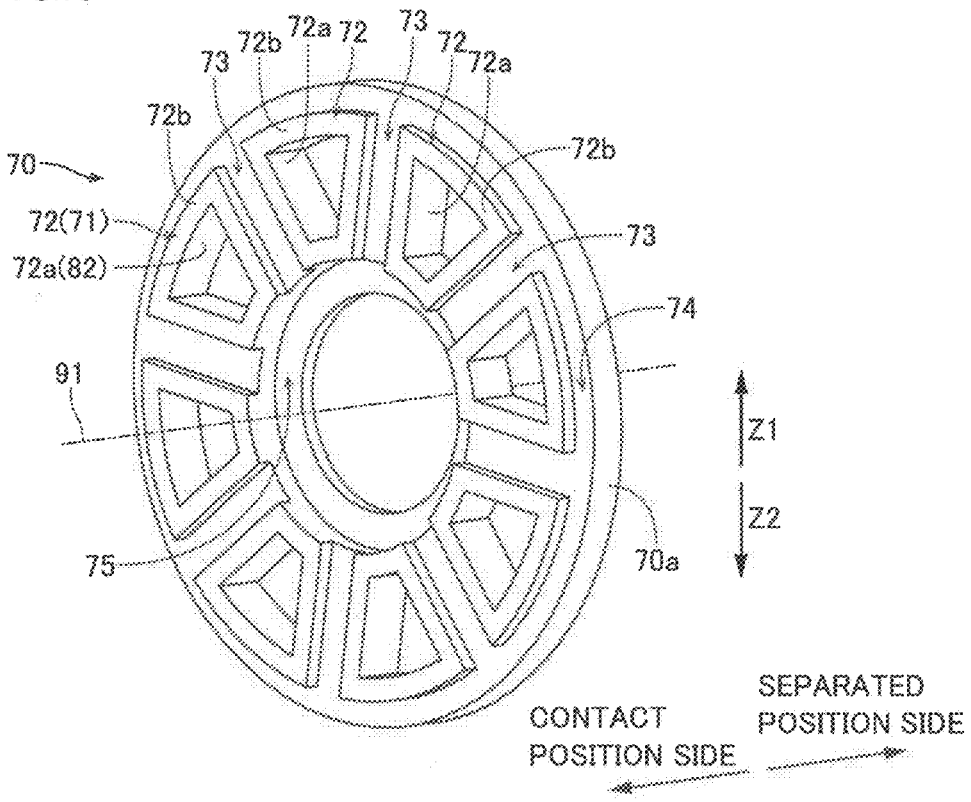
FIG. 8 is a perspective view showing an air guide of the steering cylinder of the outboard motor according to the first preferred embodiment of the present invention.

As shown in FIG. 8, in the first preferred embodiment, the air guide 70 has a disk shape. As shown in FIG. 6, the outer peripheral side flow passage 81 is defined by the outer peripheral surface 70*a* of the disk-shaped air guide 70 and the inner peripheral surface 51*c* of the oil chamber 51. Specifically, the outer peripheral side flow passage 81 is an annular gap between the outer peripheral surface 70*a* of the disk-shaped air guide 70 and the inner peripheral surface 51*c* of the oil chamber 51. The width of the annular gap between the outer peripheral surface 70*a* and the inner peripheral surface 51*c* is set to several millimeters, for example. A hole through which the piston rod 52 on the inner peripheral side of the air guide 70 penetrates is slightly larger than the diameter of the piston rod 52 (is much smaller than the width of the annular gap between the outer peripheral surface 70*a* and the inner peripheral surface 51*c*). Thus, the air guide 70 moves within a predetermined range described below in the oil chamber 51 while being guided by the outer peripheral surface 52*a* of the piston rod 52.

In the first preferred embodiment, the air guide 70 supplies hydraulic oil to the oil chamber 51 via an inner peripheral side flow passage 82 provided on the inner peripheral side of the outer peripheral side flow passage 81 in addition to the outer peripheral side flow passage 81 when the hydraulic oil is supplied to the oil chamber 51. Specifically, as shown in FIG. 8, the inner peripheral side flow passage 82 provided on the inner peripheral side of the outer peripheral side flow passage 81 is provided in the air guide 70. As shown in FIG. 6, the air guide 70 allows the hydraulic oil to pass through the outer peripheral side flow passage 81 and the inner peripheral side flow passage 82 when the hydraulic oil is supplied from the oil chamber 51 to the oil passage 42 via the oil passage connection port 55.

In the first preferred embodiment, the air guide 70 moves in the right-left direction in the oil chamber 51 to close the inner peripheral side flow passage 82 when the hydraulic oil is discharged from the oil chamber 51 and to open the inner peripheral side flow passage 82 when the hydraulic oil is supplied to the oil chamber 51. Specifically, the air guide 70 includes a contact portion 71 that contacts the end surface 56 in right-left direction in the oil chamber 51. The air guide 70 moves in the right-left direction to a contact position P1 at which the contact portion 71 contacts the end surface 56 to close the inner peripheral side flow passage 82 when the hydraulic oil is discharged from the oil chamber 51, and moves in the right-left direction to a separated position P2 at which the contact portion 71 is spaced apart from the end surface 56 to open the inner peripheral side flow passage 82 when the hydraulic oil is supplied to the oil chamber 51.

Specifically, in the first preferred embodiment, as shown in FIG. 8, the air guide 70 includes, as the contact portion 71, a plurality of (eight) first protrusions 72 that protrude toward the end surface 56 (see FIG. 6) in the right-left direction, and inside-outside connection recesses 73 located between the plurality of (eight) first protrusions 72 to connect the outer peripheral side of the oil chamber 51 to the inner peripheral side of the oil chamber 51 (see FIG. 6). The piston rod 52 (see FIG. 6) is provided on the inner peripheral side of the oil chamber 51. Furthermore, the air guide 70 includes, as the inner peripheral side flow passage 82, a through-hole 72*a* provided on at least one of the plurality of (eight) first protrusions 72 to penetrate or extend therethrough in the right-left direction. That is, as shown in FIG. 6, when the hydraulic oil is discharged from the left oil chamber 51*a* (oil chamber 51) to the oil passage 42*a* (oil passage 42) via the oil passage connection port 55*a* (oil passage connection port 55), the air guide 70 moves to the contact position P1, and surfaces 72*b* of the plurality of first protrusions 72 on the end surface 56 side in the right-left direction contact the end surface 56 in the right-left direction. In this state, the through-hole 72*a* corresponding to the inner peripheral side flow passage 82 is closed. The air 60 that has flowed from the left oil chamber 51*a* (oil chamber 51) to the end surface 56 side in the right-left direction via the outer peripheral side flow passage 81 flows from the outer peripheral side to the inner peripheral side via the inside-outside connection recesses 73. When the hydraulic oil is supplied from the oil passage 42*b* (oil passage 42) to the right oil chamber 51*b* (oil chamber 51) via the oil passage connection port 55*b* (oil passage connection port 55), the air guide 70 moves to the separated position P2, and the surfaces 72*b* of the plurality of first protrusions 72 on the end surface 56 side in the right-left direction are spaced apart from the end surface 56 in the right-left direction. In this state, the through-hole 72*a* corresponding to the inner peripheral side flow passage 82 is opened.

As shown in FIG. 8, in the first preferred embodiment, each of the plurality of (eight) first protrusions 72 has a sectoral shape as viewed in the right-left direction. The through-hole 72*a* has a sectoral shape smaller than the sectoral shape of each of the plurality of first protrusions 72 as viewed in the right-left direction. That is, the surfaces 72*b* of the plurality of first protrusions 72 on the end surface 56 side in the right-left direction that contact the end surface 56 in the right-left direction each have a sectoral frame shape. In the first preferred embodiment, the through-hole 72*a* is provided on each of the plurality of (eight) first protrusions 72.

The air guide 70 includes an annular recess 74 recessed away from the end surface 56 with respect to the plurality of first protrusions 72 on the outer peripheral side of the plurality of first protrusions 72. The annular recess 74 is connected to the outer peripheral side flow passage 81. The annular recess 74 is recessed away from the end surface 56 by the same amount as the inside-outside connection recesses 73.

The air guide 70 includes a first annular recess 75 recessed away from the end surface 56 with respect to the plurality of first protrusions 72 on the inner peripheral side on which the piston rod 52 is provided. The first annular recess 75 connects the inside-outside connection recesses 73 to the oil passage connection port 55. The first annular recess 75 is largely recessed away from the end surface 56 relative to the inside-outside connection recesses 73.

As shown in FIG. 6, in the first preferred embodiment, the air guide 70 moves to the contact position P1 in the right-left direction due to the flow of the hydraulic oil discharged from the oil chamber 51 to the oil passage connection port 55 when the hydraulic oil is discharged from the oil chamber 51, and moves to the separated position P2 in the right-left direction due to the flow of the hydraulic oil supplied from the oil passage connection port 55 to the oil chamber 51 when the hydraulic oil is supplied to the oil chamber 51. Specifically, the air guide 70 is moved toward the contact position P1 due to the flow of the hydraulic oil discharged from the left oil chamber 51*a* (oil chamber 51) to move in the right-left direction from the separated position P2 to the contact position P1 when the hydraulic oil is discharged from the left oil chamber 51*a* (oil chamber 51) to the oil passage 42*a* (oil passage 42) via the oil passage connection port 55*a* (oil passage connection port 55). Furthermore, the air guide 70 is moved toward the separated position P2 due to the flow of the hydraulic oil supplied to the right oil chamber 51*b* (oil chamber 51) to move in the right-left direction from the contact position P1 to the separated position P2 when the hydraulic oil is supplied from the oil passage 42*b* (oil passage 42) to the right oil chamber 51*b* (oil chamber 51) via the oil passage connection port 55*b* (oil passage connection port 55).

In the first preferred embodiment, the outboard motors 120 each include a restrictor 52*b* to restrict the air guide 70 from moving to the side opposite to the contact position P1 relative to the separated position P2 in the right-left direction. Specifically, the restrictor 52*b* has a stepped shape that protrudes toward the outer peripheral side relative to the oil passage connection port 55 and is provided at the end of the piston rod 52 on the oil passage connection port 55 side. Thus, the moving range of the air guide 70 is limited between the contact position P1 and the separated position P2 in the right-left direction.

According to the first preferred embodiment of the present invention, the following advantageous effects are achieved.

According to the first preferred embodiment of the present invention, the outboard motors 120 (marine vessel 100) each include the air guide 70 located in the vicinity of or adjacent to the oil passage connection port 55, which is the connection port of the oil chamber 51 to the oil passage 42, in the right-left direction to guide the air 60 remaining in the oil chamber 51 to the oil passage connection port 55 when the hydraulic oil is discharged from the oil chamber 51 via the oil passage 42. Accordingly, when the hydraulic oil is discharged from the oil chamber 51 via the oil passage 42, the air guide 70 guides the air 60 remaining in the oil chamber 51 to the oil passage connection port 55. That is, the air 60 remaining in the oil chamber 51 is guided to the oil passage connection port 55 by the normal operation of the steering cylinder 41 that discharges the hydraulic oil from the oil chamber 51 via the oil passage 42, and thus the air 60 is automatically discharged from the oil chamber 51 to the outside without an operator performing a complex operation such as tilting the steering cylinder 41. Consequently, the air in the oil chamber 51 of the steering cylinder 41 is easily bled. Furthermore, the air is bled at any time only by the user of the marine vessel 100 performing a steering operation (to change the propulsion direction of the marine vessel 100) while maneuvering the marine vessel 100, without the operator performing an air bleeding operation.

According to the first preferred embodiment of the present invention, the air guide 70 guides the air 60 remaining in the upper portion of the oil chamber 51 to the oil passage connection port 55 via the outer peripheral side flow passage 81 provided on the outer peripheral side of the air guide 70 when the hydraulic oil is discharged from the oil chamber 51. Accordingly, the upper portion (outer peripheral side) of the oil chamber 51 is closer to the outer peripheral side flow passage 81 than the inner peripheral side of the oil chamber 51, and the air 60 is lower in viscosity than the hydraulic oil, and thus when the hydraulic oil is discharged from the oil chamber 51 via the oil passage 42, the air 60 remaining in the upper portion (outer peripheral side) of the oil chamber 51 is preferentially discharged to the outside from the oil chamber 51 via the outer peripheral side flow passage 81. Consequently, when the hydraulic oil is discharged from the oil chamber 51 via the oil passage 42, the air guide 70 reliably guides the air 60 remaining in the upper portion of the oil chamber 51 to the oil passage connection port 55.

According to the first preferred embodiment of the present invention, the air guide 70 has a disk shape. Furthermore, the outer peripheral side flow passage 81 is defined by the outer peripheral surface 70*a* of the disk-shaped air guide 70 and the inner peripheral surface 51*c* of the oil chamber 51. Accordingly, with the disk-shaped air guide 70, the outer peripheral side flow passage 81 that guides the air 60 remaining in the upper portion (outer peripheral side) of the oil chamber 51 to the oil passage connection port 55 is easily provided on the outer peripheral side of the air guide 70.

According to the first preferred embodiment of the present invention, the air guide 70 supplies the hydraulic oil to the oil chamber 51 via the inner peripheral side flow passage 82 provided on the inner peripheral side of the outer peripheral side flow passage 81 in addition to the outer peripheral side flow passage 81 when the hydraulic oil is supplied to the oil chamber 51. Accordingly, when the hydraulic oil is supplied to the oil chamber 51, the sectional area of a flow passage through which the hydraulic oil is supplied is increased as compared with a case in which the flow passage through which the hydraulic oil is supplied is limited to the outer peripheral side flow passage 81. Consequently, the pressure loss of the hydraulic oil is decreased when the hydraulic oil is supplied to the oil chamber 51.

According to the first preferred embodiment of the present invention, the air guide 70 moves in the right-left direction in the oil chamber 51 to close the inner peripheral side flow passage 82 when the hydraulic oil is discharged from the oil chamber 51 and to open the inner peripheral side flow passage 82 when the hydraulic oil is supplied to the oil chamber 51. Accordingly, the air guide 70 is moved in the right-left direction in the oil chamber 51 such that the outer peripheral side flow passage 81 is easily provided when the hydraulic oil is discharged from the oil chamber 51, and the outer peripheral side flow passage 81 and the inner peripheral side flow passage 82 are easily provided when the hydraulic oil is supplied to the oil chamber 51.

According to the first preferred embodiment of the present invention, the air guide 70 includes the contact portion 71 that contacts the end surface 56 in the right-left direction in the oil chamber 51. Furthermore, the air guide 70 moves in the right-left direction to the contact position P1 at which the contact portion 71 contacts the end surface 56 to close the inner peripheral side flow passage 82 when the hydraulic oil is discharged from the oil chamber 51, and moves in the right-left direction to the separated position P2 at which the contact portion 71 is spaced apart from the end surface 56 to open the inner peripheral side flow passage 82 when the hydraulic oil is supplied to the oil chamber 51. Accordingly, the air guide 70 is moved in the right-left direction between the contact position P1 and the separated position P2 in the oil chamber 51 such that the inner peripheral side flow passage 82 is easily closed when the hydraulic oil is discharged from the oil chamber 51, and the inner peripheral side flow passage 82 is easily opened when the hydraulic oil is supplied to the oil chamber 51.

According to the first preferred embodiment of the present invention, the air guide 70 moves to the contact position P1 in the right-left direction due to the flow of the hydraulic oil discharged from the oil chamber 51 to the oil passage connection port 55 when the hydraulic oil is discharged from the oil chamber 51, and moves to the separated position P2 in the right-left direction due to the flow of the hydraulic oil supplied from the oil passage connection port 55 to the oil chamber 51 when the hydraulic oil is supplied to the oil chamber 51. Accordingly, the air guide 70 is moved to the contact position P1 in the right-left direction through the normal operation of the steering cylinder 41 that discharges the hydraulic oil from the oil chamber 51, and the air guide 70 is moved to the separated position P2 in the right-left direction through the normal operation of the steering cylinder 41 that supplies the hydraulic oil to the oil passage 42, and thus the air guide 70 is moved in the right-left direction to the contact position P1 and the separated position P2 in the oil chamber 51 without separately providing a dedicated movement mechanism to move the air guide 70.

According to the first preferred embodiment of the present invention, the outboard motors 120 (marine vessel 100) each include the restrictor 52*b* to restrict the air guide 70 from moving to the side opposite to the contact position P1 relative to the separated position P2 in the right-left direction. Accordingly, the moving range of the air guide 70 is limited between the contact position P1 and the separated position P2 in the right-left direction by the restrictor 52*b*, and thus an excessive increase in the moving range of the air guide 70 is significantly reduced or prevented.

According to the first preferred embodiment of the present invention, the oil passage connection port 55 is located in the vicinity of or adjacent to the end surface 56 in the right-left direction. Accordingly, the separated position P2 is located relatively close to the end surface 56 in the right-left direction, and thus an excessive increase in the moving range of the air guide 70 is significantly reduced or prevented.

According to the first preferred embodiment of the present invention, the oil passage 42 is provided in the piston rod 52. Furthermore, the oil passage connection port 55 is provided on the outer peripheral surface 52*a* of the piston rod 52 provided in the cylinder body 54. Moreover, the piston rod 52 is provided on the inner peripheral side of the oil chamber 51, and the air guide 70 includes, as the contact portion 71, the plurality of first protrusions 72 that protrude toward the end surface 56 in the right-left direction, and the inside-outside connection recesses 73 located between the plurality of first protrusions 72 to connect the outer peripheral side of the oil chamber 51 to the inner peripheral side. Accordingly, the plurality of first protrusions 72 corresponding to the contact portion 71 easily close the inner peripheral side flow passage 82 when the hydraulic oil is discharged from the oil chamber 51, and easily open the inner peripheral side flow passage 82 when the hydraulic oil is supplied to the oil chamber 51. Furthermore, the inside-outside connection recesses 73 easily connect, on the end surface 56 side of the air guide 70, the outer peripheral side flow passage 81 to the oil passage connection port 55 provided on the outer peripheral surface 52*a* of the piston rod 52 on the inner peripheral side when the hydraulic oil is discharged from the oil chamber 51, and easily connect, on the end surface 56 side of the air guide 70, the outer peripheral side flow passage 81 and the inner peripheral side flow passage 82 to the oil passage connection port 55 when the hydraulic oil is supplied to the oil chamber 51.

According to the first preferred embodiment of the present invention, the air guide 70 includes, as the inner peripheral side flow passage 82, the through-hole 72*a* provided on at least one of the plurality of first protrusions 72 to penetrate therethrough in the right-left direction. Accordingly, with the through-hole 72*a*, the inner peripheral side flow passage 82, which is closed due to contact of the plurality of first protrusions 72 with the end surface 56 in the right-left direction when the hydraulic oil is discharged from the oil chamber 51, and is opened due to being spaced apart from the plurality of first protrusions 72 from the end surface 56 in the right-left direction when the hydraulic oil is supplied to the oil chamber 51, is easily provided.

According to the first preferred embodiment of the present invention, the through-hole 72*a* is provided on each of the plurality of first protrusions 72. Accordingly, the sectional area of the inner peripheral side flow passage 82 is easily increased as compared with a case in which the through-hole 72*a* is provided on one or more but not all of the plurality of first protrusions 72. Consequently, the pressure loss of the hydraulic oil is effectively decreased when the hydraulic oil is supplied to the oil chamber 51.

According to the first preferred embodiment of the present invention, the plurality of first protrusions 72 each have a sectoral shape as viewed in the right-left direction, and the through-hole 72*a* has a sectoral shape smaller than the sectoral shape of each of the plurality of first protrusions 72 as viewed in the right-left direction. Accordingly, the sectional area of the inner peripheral side flow passage 82 is easily increased as compared with a case in which the through-hole 72*a* does not have the same sectoral shape as the plurality of first protrusions 72. Consequently, the pressure loss of the hydraulic oil is effectively decreased when the hydraulic oil is supplied to the oil chamber 51.

According to the first preferred embodiment of the present invention, the oil passage connection port 55 is provided on a portion of the outer peripheral surface 52*a* of the piston rod 52 in the circumferential direction. Furthermore, the air guide 70 includes the first annular recess 75 recessed away from the end surface 56 with respect to the plurality of first protrusions 72 on the inner peripheral side, on which the piston rod 52 is provided, to connect the inside-outside connection recesses 73 to the oil passage connection port 55. Accordingly, the inside-outside connection recesses 73 that connect the outer peripheral side to the inner peripheral side with the piston rod 52 are easily connected to the oil passage connection port 55 provided on a portion of the outer peripheral surface 52*a* of the piston rod 52 in the circumferential direction by the first annular recess 75.

Second Preferred Embodiment

The structure of a marine vessel 200 including outboard motors 220 (two outboard motors, for example) according to a second preferred embodiment of the present invention is now described with reference to FIGS. 9 and 11. In the figures, the same or similar structures as those of the outboard motors 120 and the marine vessel 100 according to the first preferred embodiment are denoted by the same reference numerals.

Figure 9:
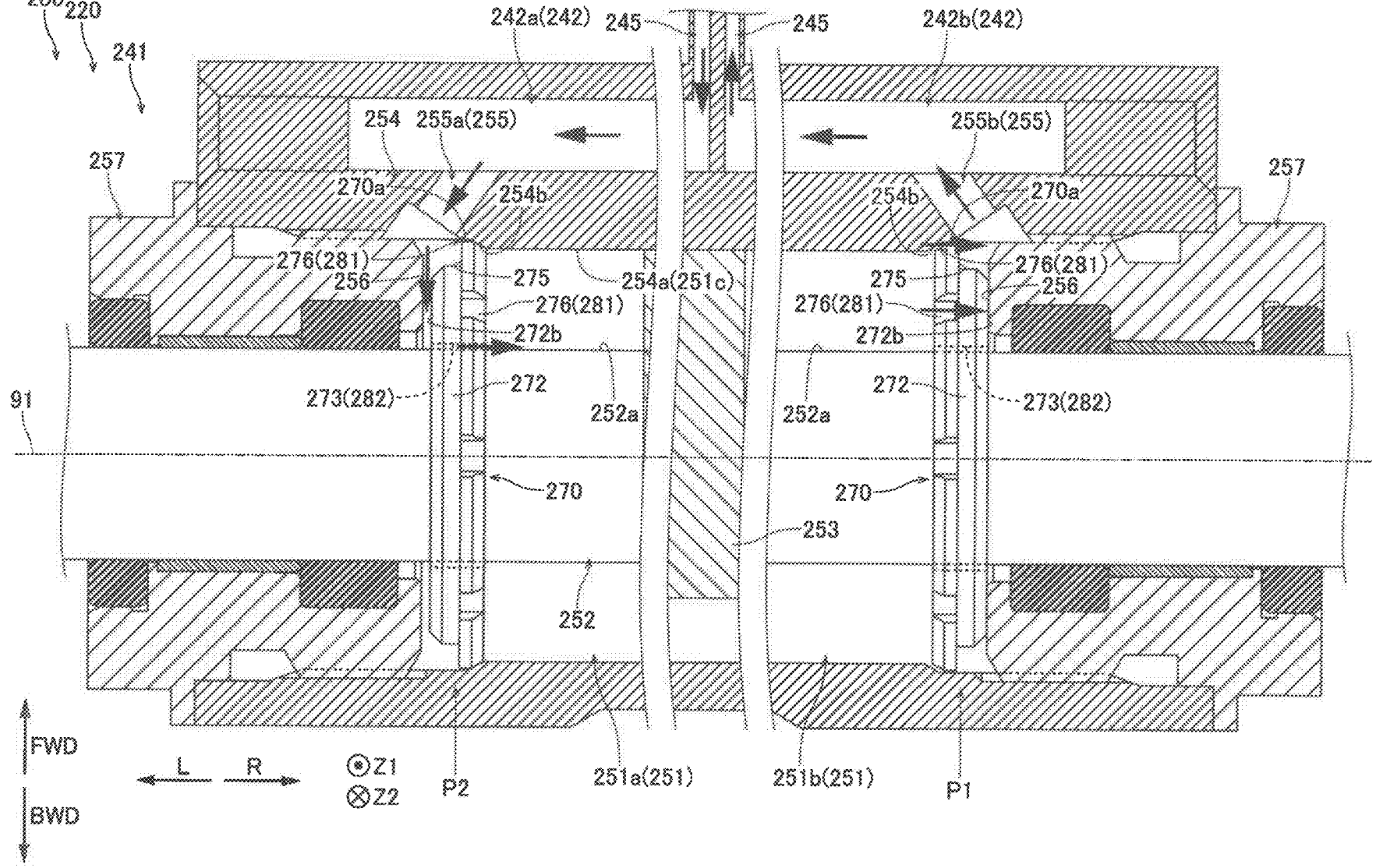
FIG. 9 is an enlarged plan sectional view of the vicinity of a piston of a steering cylinder of an outboard motor according to a second preferred embodiment of the present invention.

As shown in FIG. 9, in the second preferred embodiment, an oil passage 242 is located in front of a steering cylinder 241, unlike the first preferred embodiment in which the oil passage 42 is provided inside the piston rod 52. Specifically, in front of an oil chamber 251, the oil passage 242 including a first end connected to oil pipes 245 and a second end connected to the oil chamber 251 is aligned with the steering cylinder 241 in a forward-rearward direction and extends in a right-left direction. The oil passage 242 includes an oil passage 242*a* connected to a left oil chamber 251*a* and an oil passage 242*b* connected to a right oil chamber 251*b*. The oil passage 242*a* is connected to the left oil chamber 251*a* on the left end cap 257 side of the steering cylinder 241 and is connected to one of the oil pipes 245 on the piston 253 side of the steering cylinder 241. Furthermore, the oil passage 242*b* is connected to the right oil chamber 251*b* on the right end cap 257 side of the steering cylinder 241 and is connected to the other of the oil pipes 245 on the piston 253 side of the steering cylinder 241. FIG. 9 shows a state in which hydraulic oil is supplied from the oil passage 242*a* to the left oil chamber 251*a* via an oil passage connection port 255*a*, and hydraulic oil is discharged from the right oil chamber 251*b* to the oil passage 242*b* via an oil passage connection port 255*b*. In FIG. 9, the hatching of an air guide 270 indicating a cross-section is omitted in order to clearly show the shape of the air guide 270.

In the second preferred embodiment, an oil passage connection port 255, which is a connection port of the oil chamber 251 to the oil passage 242, is provided on a portion of the inner peripheral surface 254*a* of a cylinder body 254 (the inner peripheral surface 251*c* of the oil chamber 251) in a circumferential direction, unlike the first preferred embodiment in which the oil passage connection port 55 is located in a portion of the outer peripheral surface 52*a* of the piston rod 52 provided in the cylinder body 54 in the circumferential direction. Specifically, the oil passage connection port 255*a* of the oil passage 242*a* connected to the left oil chamber 251*a* extends from the oil passage 242*a* to an end (inner peripheral surface 251*c*) of the left oil chamber 251*a* on the oil passage 242*a* side toward the inner circumference side inside an outer peripheral portion (having a tubular shape) of the cylinder body 254. The oil passage connection port 255*b* of the oil passage 242*b* connected to the right oil chamber 251*b* extends from the oil passage 242*b* to an end (inner peripheral surface 251*c*) of the right oil chamber 251*b* on the oil passage 242*b* side toward the inner circumference side inside the outer peripheral portion of the cylinder body 254.

In the second preferred embodiment, the oil passage connection port 255 is located in the vicinity of or adjacent to an end surface 256 (on the side opposite to the piston 253 side) of the oil chamber 251 in the right-left direction, unlike the first preferred embodiment in which the oil passage connection port 55 is located in the vicinity of or adjacent to the end surface 56 (on the piston 53 side) of the oil chamber 51 in the right-left direction.

Figure 10:
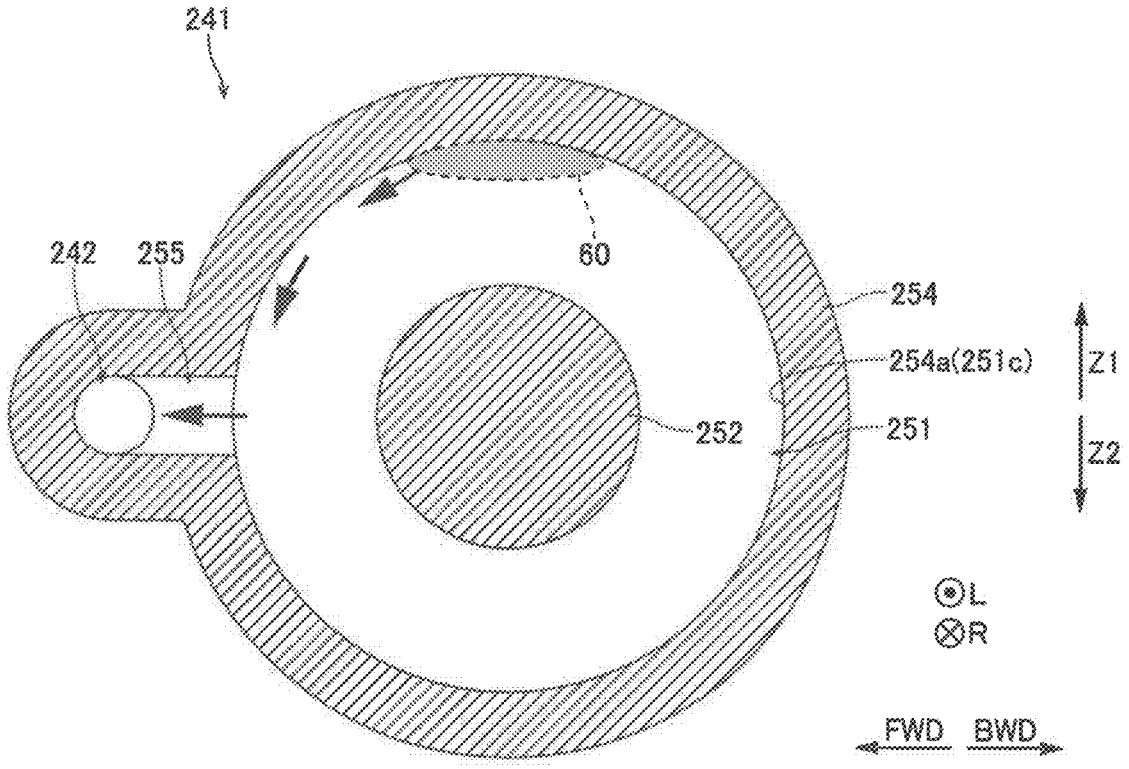
FIG. 10 is a schematic sectional view illustrating air discharge from an oil chamber of the steering cylinder of the outboard motor according to the second preferred embodiment of the present invention.

In the second preferred embodiment, the outboard motors 220 each include the air guide 270 located in the vicinity of or adjacent to the oil passage connection port 255 to guide air 60 (see FIG. 10) remaining in the oil chamber 251 to the oil passage connection port 255 when the hydraulic oil is discharged from the oil chamber 251 via the oil passage 242, similarly to the first preferred embodiment. As shown in FIG. 10, the air 60 remains in the oil chamber 251 without being discharged from the oil passage connection port 255 after the air 60 enters the oil chamber 251 when the steering cylinder 241 is assembled, similarly to the first preferred embodiment.

Figure 11:
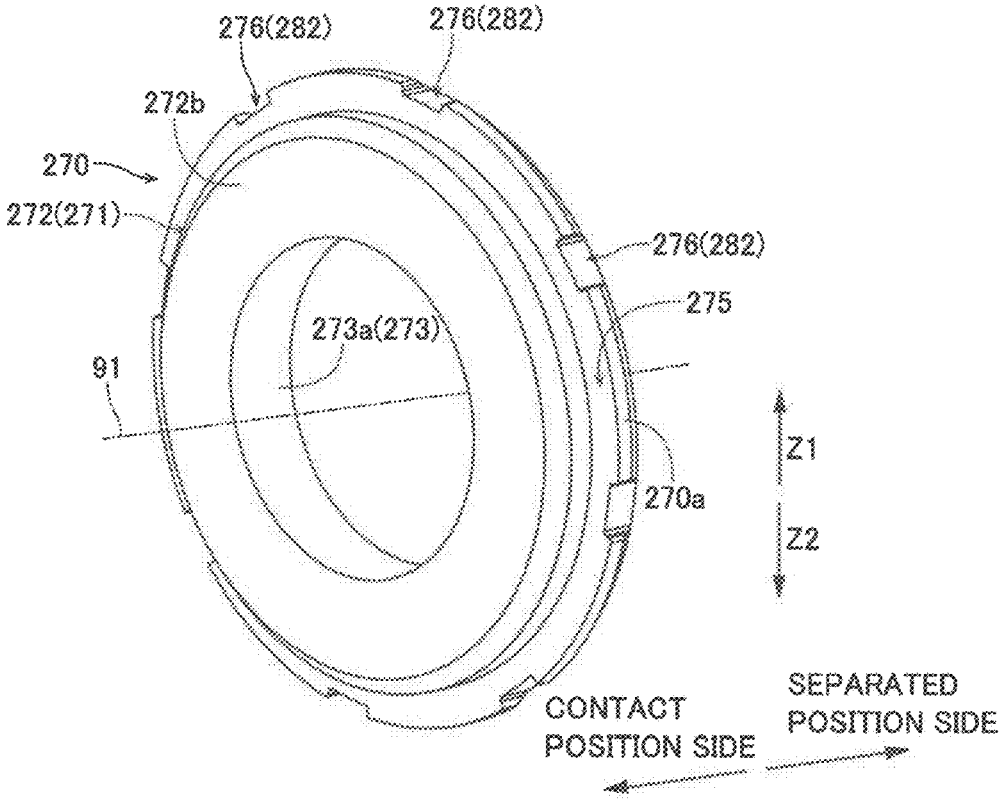
FIG. 11 is a perspective view showing an air guide of the steering cylinder of the outboard motor according to the second preferred embodiment of the present invention.

As shown in FIG. 11, in the second preferred embodiment, the air guide 270 includes, as a contact portion 271, a second protrusion 272 that protrudes toward the end surface 256 (see FIG. 6) of the oil chamber 251, unlike the first preferred embodiment in which the air guide 70 includes the plurality of (eight) first protrusions 72 as the contact portion 71 and the inside-outside connection recesses 73 located between the plurality of (eight) first protrusions 72. That is, as shown in FIG. 9, when the hydraulic oil is discharged from the right oil chamber 251*b* (oil chamber 251) to the oil passage 242*b* (oil passage 242) via the oil passage connection port 255*b* (oil passage connection port 255), a surface 272*b* of the second protrusion 272 on the end surface 256 side in the right-left direction contacts the end surface 256 in the right-left direction. In this state, an inner peripheral side flow passage 282 is closed.

In the second preferred embodiment, the inner peripheral side flow passage 282 is an annular gap between the outer peripheral surface 252*a* of a piston rod 252 and the inner peripheral surface 273*a* of a through-hole 273 that penetrates in the right-left direction in a central portion of the air guide 270, unlike the first preferred embodiment in which the through-hole 72*a* is provided as the inner peripheral side flow passage 82 on at least one of the first protrusions 72 to penetrate therethrough in the right-left direction. The width of the annular gap between the outer peripheral surface 252*a* and the inner peripheral surface 273*a* is set to several millimeters, for example.

In the second preferred embodiment, the air guide 270 includes notches 276 as the outer peripheral flow passage 281, unlike the first preferred embodiment in which the annular gap is provided as the outer peripheral side flow passage 81 between the outer peripheral surface 70*a* of the disk-shaped air guide 70 and the inner peripheral surface 51*c* of the oil chamber 51. The notches 276 are provided on the outer peripheral side to penetrate in the right-left direction. The notches 276 are portions of the outer peripheral surface 270*a* of the air guide 270. A plurality of (eight, for example) of notches 276*a* are provided at equal or substantially equal intervals as viewed in the axial direction (right-left direction) of the piston rod 252. The diameter of a portion of the outer peripheral surface 270*a* of the air guide 270 without the notches is slightly smaller than the diameter of the inner peripheral surface 254*a* of the cylinder body 254 within a predetermined range (at a contact position P1 and a separated position P2). Thus, the air guide 270 moves within the predetermined range in the oil chamber 251 while being guided by the inner peripheral surface 254*a* of the cylinder body 254.

In the second preferred embodiment, the air guide 270 includes a second annular recess 275. The second annular recess 275 is recessed away from the end surface 256 with respect to the second protrusion 272 on the outer peripheral side and is connected to the oil passage connection port 255.

In the second preferred embodiment, a restrictor 254*b* has a stepped shape that is recessed to the outer peripheral side as compared with the inner peripheral surface 254*a* on the piston 253 side and is located in the vicinity of or adjacent to the oil passage connection port 255 of the inner peripheral surface 254*a* of the cylinder body 254, unlike the first preferred embodiment in which the restrictor 52*b* that protrudes toward the outer peripheral side relative to the oil passage connection port 55 is provided at the end of the piston rod 52 on the oil passage connection port 55 side.

The remaining structures of the second preferred embodiment are similar to those of the first preferred embodiment.

According to the second preferred embodiment of the present invention, the following advantageous effects are achieved.

According to the second preferred embodiment of the present invention, the outboard motors 220 (marine vessel 200) each include the air guide 270 located in the vicinity of or adjacent to the oil passage connection port 255, which is the connection port of the oil chamber 251 to the oil passage 242, in the right-left direction to guide the air 60 remaining in the oil chamber 251 to the oil passage connection port 255 when the hydraulic oil is discharged from the oil chamber 251 via the oil passage 242. Accordingly, similarly to the first preferred embodiment, the air 60 remaining in the oil chamber 251 is guided to the oil passage connection port 255 by the normal operation of the steering cylinder 241 that discharges the hydraulic oil from the oil chamber 251 via the oil passage 242, and thus the air 60 is automatically discharged from the oil chamber 251 to the outside without an operator performing a complex operation such as tilting the steering cylinder 241. Consequently, similarly to the first preferred embodiment, the air in the oil chamber 251 of the steering cylinder 241 is easily bled.

According to the second preferred embodiment of the present invention, the oil passage 242 is located in front of the steering cylinder 241. Furthermore, the oil passage connection port 255 is provided on the inner peripheral surface 254*a* of the cylinder body 254. Moreover, the air guide 270 includes, as the contact portion 271, the second protrusion 272 that protrudes toward the end surface 256 of the oil chamber 251. Accordingly, the second protrusion 272 corresponding to the contact portion 271 easily closes the inner peripheral side flow passage 282 when the hydraulic oil is discharged from the oil chamber 251, and easily opens the inner peripheral side flow passage 282 when the hydraulic oil is supplied to the oil chamber 251.

According to the second preferred embodiment of the present invention, the air guide 270 includes, as the outer peripheral side flow passage 281, the notches 276 provided on the outer peripheral side to penetrate in the right-left direction. Accordingly, with the notches 276, the outer peripheral side flow passage 281 is easily provided in the oil chamber 251 when the hydraulic oil is discharged from the oil chamber 251.

According to the second preferred embodiment of the present invention, the oil passage connection port 255 is provided on a portion of the inner peripheral surface 254*a* of the cylinder body 254 in the circumferential direction. Furthermore, the air guide 270 includes the second annular recess 275 recessed away from the end surface 256 with respect to the second protrusion 272 on the outer peripheral side and is connected to the oil passage connection port 255. Accordingly, the outer peripheral side flow passage 281 is easily connected to the oil passage connection port 255 provided on a portion of the inner peripheral surface 254*a* of the cylinder body 254 in the circumferential direction by the second annular recess 275.

The remaining advantageous effects of the second preferred embodiment are similar to those of the first preferred embodiment.

The preferred embodiments of the present invention described above are illustrative in all points and not restrictive. The extent of the present invention is not defined by the above description of the preferred embodiments but by the scope of the claims, and all modifications within the meaning and range equivalent to the scope of the claims are further included.

For example, while the marine vessel preferably includes two outboard motors in each of the first and second preferred embodiments described above, the present invention is not restricted to this. In the present invention, the marine vessel may alternatively include one or three or more outboard motors.

While the oil passage 242 is preferably located in front of the steering cylinder 241 in the second preferred embodiment described above, the present invention is not restricted to this. In the present invention, the oil passage may alternatively be provided behind the steering cylinder or below the steering cylinder.

Figure 12:
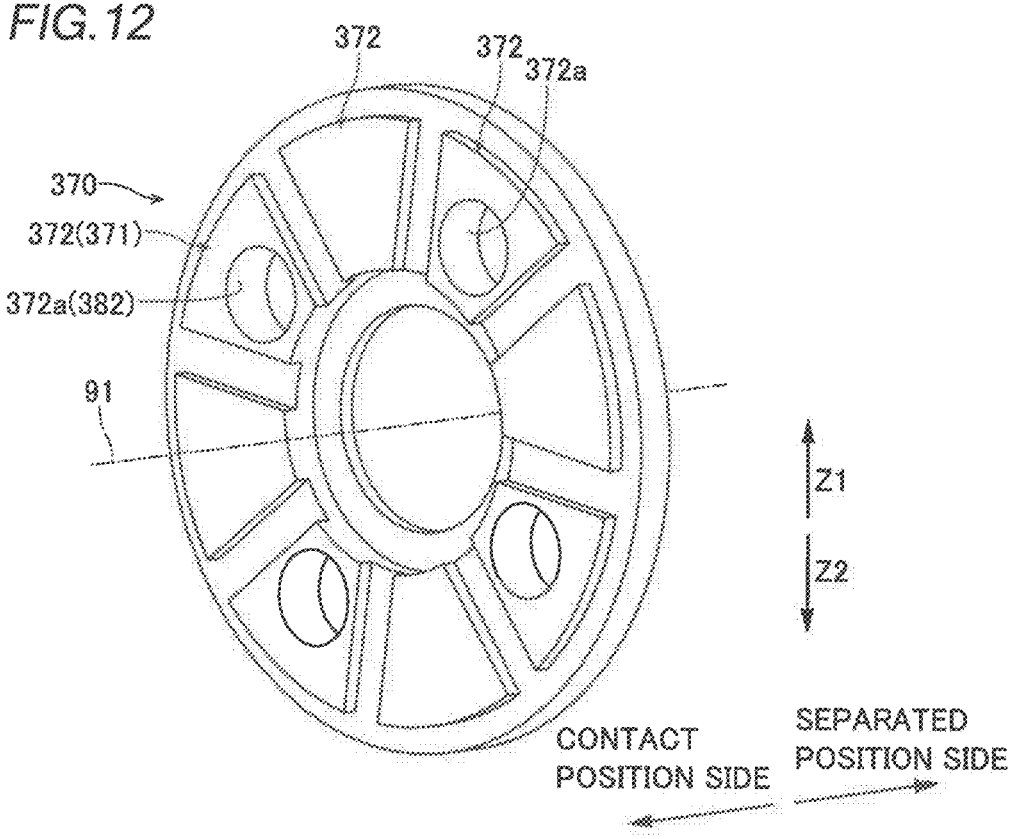
FIG. 12 is a perspective view showing an air guide of a steering cylinder of an outboard motor according to a first modified example of the first preferred embodiment of the present invention.

While the through-hole 72*a* corresponding to the inner peripheral side flow passage 82 is preferably provided on each of the plurality of first protrusions 72 corresponding to the contact portion 71 in the first preferred embodiment described above, the present invention is not restricted to this. In the present invention, as in an air guide 370 according to a first modified example shown in FIG. 12, a through-hole 372*a* corresponding to an inner peripheral side flow passage 382 may alternatively be provided only on one or more but not all of the plurality of first protrusions 372 corresponding to the contact portion 371.

While each of the plurality of first protrusions 72 preferably has a sectoral shape as viewed in the right-left direction, and the through-hole 72*a* corresponding to the inner peripheral side flow passage 82 preferably has a sectoral shape smaller than the sectoral shape of each of the plurality of first protrusions 72 as viewed in the right-left direction in the first preferred embodiment described above, the present invention is not restricted to this. In the present invention, as in the air guide 370 according to the first modified example shown in FIG. 12, each of the plurality of first protrusions 372 may alternatively have a sectoral shape as viewed in the right-left direction, and the through-hole 372*a* corresponding to the inner peripheral side flow passage 382 may alternatively have a shape other than the sectoral shape as viewed in the right-left direction. Furthermore, although not shown, each of the plurality of first protrusions may alternatively have a shape other than the sectoral shape as viewed in the right-left direction.

While the air guide 70 preferably includes the annular recess 74 recessed away from the end surface 56 with respect to the plurality of first protrusions 72 on the outer peripheral side of the plurality of first protrusions 72 and connected to the outer peripheral side flow passage 81 in the first preferred embodiment described above, the present invention is not restricted to this. In the present invention, the air guide may not include the annular recess recessed away from the end surface with respect to the plurality of first protrusions on the outer peripheral side of the plurality of first protrusions and connected to the outer peripheral side flow passage.

While the plurality of oil passage connection ports 55 are preferably provided at equal or substantially equal intervals in the circumferential direction on the outer peripheral surface 52*a* of the piston rod 52 in the first preferred embodiment described above, the present invention is not restricted to this. In the present invention, the plurality of oil passage connection ports may alternatively be provided at non-uniform intervals in the circumferential direction on the outer peripheral surface of the piston rod. Furthermore, only one oil passage connection port may alternatively be provided in the circumferential direction on the outer peripheral surface of the piston rod.

Figure 13:
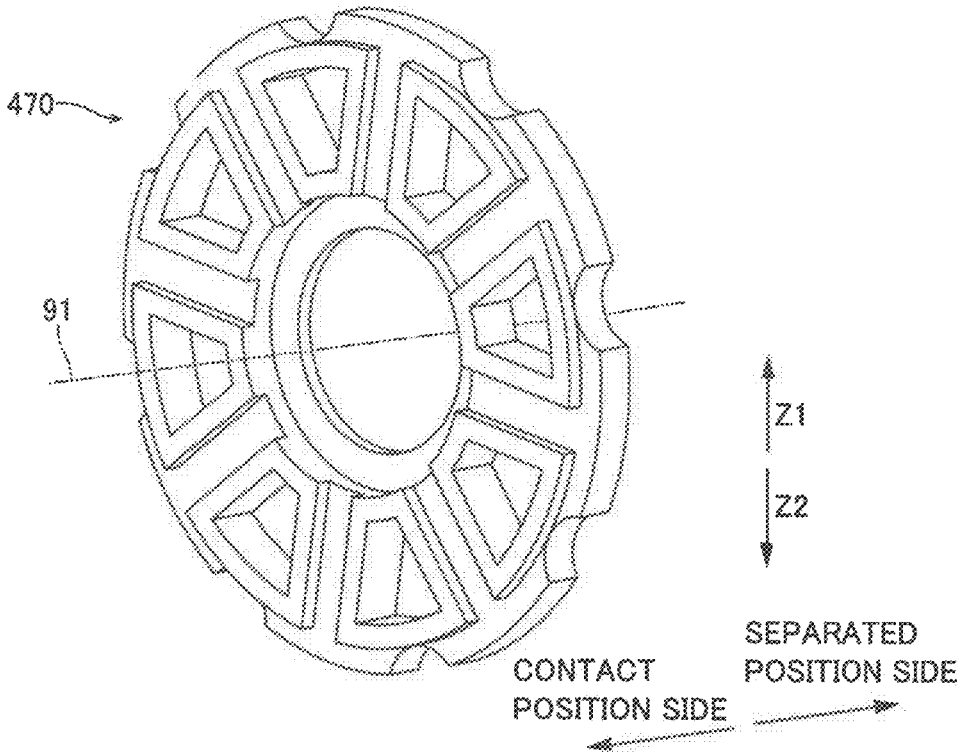
FIG. 13 is a perspective view showing an air guide of a steering cylinder of an outboard motor according to a second modified example of the first preferred embodiment of the present invention.
Figure 14:
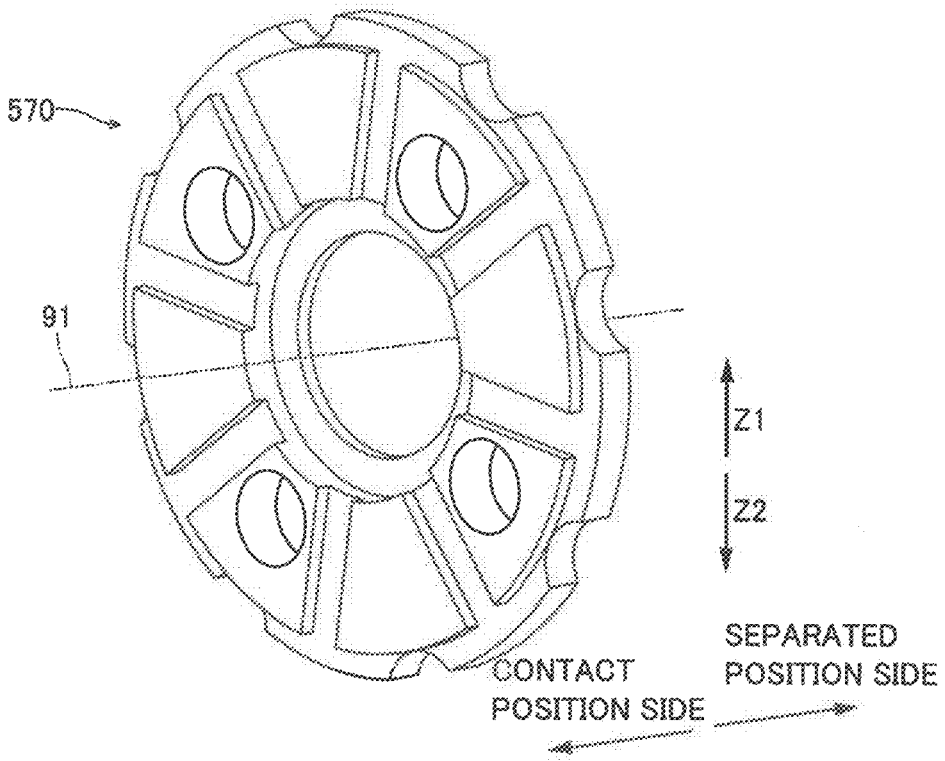
FIG. 14 is a perspective view showing an air guide of a steering cylinder of an outboard motor according to a third modified example of the first preferred embodiment of the present invention.

While the air guide 270 preferably includes, as the outer peripheral flow passage 281, the notches 276 provided on the outer peripheral side to penetrate in the right-left direction in the second preferred embodiment described above, the present invention is not restricted to this. In the present invention, as in an air guide 470 according to a second modified example shown in FIG. 13, the air guide according to the first preferred embodiment may alternatively include notches as an outer peripheral side flow passage, or as in an air guide 570 according to a third modified example shown in FIG. 14, the air guide according to the first modified example may alternatively include notches as an outer peripheral side flow passage.

While the air guide 70 (270) preferably supplies the hydraulic oil to the oil chamber 51 (251) via the inner peripheral side flow passage 82 (282) in addition to the outer peripheral side flow passage 81 (281) when the hydraulic oil is supplied to the oil chamber 51 (251) in each of the first and second preferred embodiments described above, the present invention is not restricted to this. In the present invention, the air guide may alternatively supply the hydraulic oil to the oil chamber not via the inner peripheral side flow passage but via the outer peripheral side flow passage when the hydraulic oil is supplied to the oil chamber.

While an electric signal is preferably transmitted from the steering wheel 111 to the steering control unit provided in each of the outboard motors 120 (220) as the user operates the steering wheel 111, the steering control unit preferably controls the steering motor 46*b* of the steering device 40 provided in each of the outboard motors 120 (220) to change the propulsion direction of the hull 110 (210) based on the electric signal transmitted from the steering wheel 111, and the steering pump 46*a* provided in each of the outboard motors 120 (220) is preferably driven by the control of the steering motor 46*b* to supply the hydraulic oil from the steering pump 46*a* to the oil chamber 51 (251) and discharge the hydraulic oil from the oil chamber 51 (251) to the outside in each of the first and second preferred embodiments described above, the present invention is not restricted to this. In the present invention, as the user operates the steering wheel, a mechanical steering pump provided in the hull may alternatively be driven to supply the hydraulic oil to the oil chamber of the steering cylinder provided in each of the outboard motors and discharge the hydraulic oil from the oil chamber.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

an outboard motor body;

a steering shaft;

a steering cylinder including:

a piston rod extending in a right-left direction of the outboard motor body;

a piston fixed to the piston rod; and a cylinder body including therein the piston and an oil chamber to store hydraulic oil;

an oil passage connected to the oil chamber via an oil passage connection port to supply the hydraulic oil to the oil chamber and discharge the hydraulic oil from the oil chamber; and an air guide, having a disk shape and located in a vicinity of or adjacent to the oil passage connection port in the right-left direction, to guide air remaining in the oil chamber to the oil passage connection port when the hydraulic oil is discharged from the oil chamber via the oil passage; wherein the steering cylinder is operable to rotate the steering shaft and the outboard motor body in the right-left direction by adjusting an amount of the hydraulic oil in the oil chamber and moving the cylinder body in the right-left direction.

2. The outboard motor according to claim 1, wherein the air guide is operable to guide air remaining in an upper portion of the oil chamber to the oil passage connection port via an outer peripheral side flow passage provided on an outer peripheral side of the air guide when the hydraulic oil is discharged from the oil chamber.

3. The outboard motor according to claim 2, wherein the outer peripheral side flow passage is defined by an outer peripheral surface of the air guide and an inner peripheral surface of the oil chamber.

4. The outboard motor according to claim 2, wherein the air guide is operable to supply the hydraulic oil to the oil chamber via an inner peripheral side flow passage provided on an inner peripheral side of the outer peripheral side flow passage in addition to the outer peripheral side flow passage when the hydraulic oil is supplied to the oil chamber.

5. The outboard motor according to claim 4, wherein the air guide is operable to move in the right-left direction in the oil chamber to close the inner peripheral side flow passage when the hydraulic oil is discharged from the oil chamber and to open the inner peripheral side flow passage when the hydraulic oil is supplied to the oil chamber.

6. The outboard motor according to claim 5, wherein the air guide includes a contact portion to contact an end surface of the oil chamber in the right-left direction; and the air guide is operable to move in the right-left direction to a contact position at which the contact portion contacts the end surface to close the inner peripheral side flow passage when the hydraulic oil is discharged from the oil chamber, and to move in the right-left direction to a separated position at which the contact portion is spaced apart from the end surface to open the inner peripheral side flow passage when the hydraulic oil is supplied to the oil chamber.

7. The outboard motor according to claim 6, wherein the air guide is operable to move to the contact position in the right-left direction due to a flow of the hydraulic oil discharged from the oil chamber to the oil passage connection port when the hydraulic oil is discharged from the oil chamber, and to move to the separated position in the right-left direction due to a flow of the hydraulic oil supplied from the oil passage connection port to the oil chamber when the hydraulic oil is supplied to the oil chamber.

8. The outboard motor according to claim 6, further comprising:

a restrictor to restrict the air guide from moving to a side opposite to the contact position relative to the separated position in the right-left direction.

9. The outboard motor according to claim 6, wherein the oil passage connection port is located in a vicinity of or adjacent to the end surface of the oil chamber in the right-left direction.

10. The outboard motor according to claim 6, wherein the oil passage is provided in the piston rod;

the oil passage connection port is provided on an outer peripheral surface of the piston rod;

the piston rod is provided on an inner peripheral side of the oil chamber; and the air guide further includes, as the contact portion, a plurality of first protrusions that protrude toward the end surface in the right-left direction, and an inside-outside connection recess located between the plurality of first protrusions to connect an outer peripheral side of the oil chamber to the inner peripheral side.

11. The outboard motor according to claim 10, wherein the air guide further includes, as the inner peripheral side flow passage, a through-hole provided on at least one of the plurality of first protrusions extending therethrough in the right-left direction.

12. The outboard motor according to claim 11, wherein the through-hole is provided on each of the plurality of first protrusions.

13. The outboard motor according to claim 11, wherein the plurality of first protrusions each have a sectoral shape as viewed in the right-left direction; and the through-hole has a sectoral shape smaller than the sectoral shape of each of the plurality of first protrusions as viewed in the right-left direction.

14. The outboard motor according to claim 10, wherein the oil passage connection port is provided on a portion of the outer peripheral surface in a circumferential direction of the piston rod; and the air guide further includes a first annular recess recessed away from the end surface with respect to the plurality of first protrusions on the inner peripheral side to connect the inside-outside connection recess to the oil passage connection port.

15. The outboard motor according to claim 6, wherein the oil passage is located in front of, behind, or below the steering cylinder;

the oil passage connection port is provided on an inner peripheral surface of the cylinder body; and the air guide further includes, as the contact portion, a second protrusion that protrudes toward the end surface in the oil chamber.

16. The outboard motor according to claim 15, wherein the air guide further includes, as the outer peripheral side flow passage, a notch provided on the outer peripheral side of the air guide extending therethrough in the right-left direction.

17. The outboard motor according to claim 15, wherein the oil passage connection port is provided on a portion of the inner peripheral surface in a circumferential direction of the cylinder body; and the air guide further includes a second annular recess recessed away from the end surface with respect to the second protrusion on the outer peripheral side of the air guide and connected to the oil passage connection port.

18. A marine vessel comprising:

a hull including a steering wheel; and an outboard motor attached to the hull; wherein the outboard motor includes:

an outboard motor body;

a steering shaft;

a steering cylinder including:

a piston rod extending in a right-left direction of the outboard motor body;

a piston fixed to the piston rod; and a cylinder body including therein the piston and an oil chamber to store hydraulic oil;

an oil passage connected to the oil chamber via an oil passage connection port to supply the hydraulic oil to the oil chamber and discharge the hydraulic oil from the oil chamber; and an air guide, having a disk shape and located in a vicinity of or adjacent to the oil passage connection port in the right-left direction, to guide air remaining in the oil chamber to the oil passage connection port when the hydraulic oil is discharged from the oil chamber via the oil passage; wherein the steering cylinder is operable to rotate the steering shaft and the outboard motor body in the right-left direction by adjusting an amount of the hydraulic oil in the oil chamber and moving the cylinder body in the right-left direction based on an operation of the steering wheel.

19. The marine vessel according to claim 18, wherein the air guide is operable to guide air remaining in an upper portion of the oil chamber to the oil passage connection port via an outer peripheral side flow passage provided on an outer peripheral side of the air guide when the hydraulic oil is discharged from the oil chamber.

20. The marine vessel according to claim 19, wherein the outer peripheral side flow passage is defined by an outer peripheral surface of the air guide and an inner peripheral surface of the oil chamber.

* * * * *